US007823494B2

(12) United States Patent
Baba

(10) Patent No.: US 7,823,494 B2
(45) Date of Patent: Nov. 2, 2010

(54) SHEET HOLE PUNCHING APPARATUS AND SHEET HOLE PUNCHING METHOD

(75) Inventor: Kenji Baba, Kawasaki (JP)

(73) Assignee: Seiko Ltd., Kawasaki-shi, Kanagawa (JP)

( * ) Notice: Subject to any disclaimer, the term of this patent is extended or adjusted under 35 U.S.C. 154(b) by 220 days.

(21) Appl. No.: 11/727,940

(22) Filed: Mar. 29, 2007

(65) Prior Publication Data

US 2007/0227324 A1 Oct. 4, 2007

(30) Foreign Application Priority Data

| | | |
|---|---|---|
| Mar. 31, 2006 | (JP) | 2006-100253 |
| Aug. 3, 2006 | (JP) | 2006-212535 |
| Jan. 15, 2007 | (JP) | 2007-005512 |
| Jan. 30, 2007 | (JP) | 2007-019457 |
| Mar. 9, 2007 | (JP) | 2007-060841 |

(51) Int. Cl.
*B26F 1/04* (2006.01)

(52) U.S. Cl. ..... 83/628; 83/618; 83/687; 408/135; 408/153

(58) Field of Classification Search ..... 83/618, 83/627–629, 632, 684, 686, 687, 691, 628, 83/631; 234/43, 94, 97, 98, 101; 408/459, 408/161, 173, 67, 87, 135, 153; 270/5.02, 270/5.03, 21.1, 30.08, 52.17; 399/385, 407
See application file for complete search history.

(56) References Cited

U.S. PATENT DOCUMENTS

| | | | | |
|---|---|---|---|---|
| 1,345,395 | A * | 7/1920 | Packheiser | 408/102 |
| 2,528,282 | A * | 10/1950 | Melberg | 83/105 |
| 5,676,497 | A * | 10/1997 | Kim | 408/21 |
| 6,622,908 | B2 * | 9/2003 | Fukumoto et al. | 234/98 |
| 6,860,478 | B2 * | 3/2005 | Hirai | 270/58.07 |
| 7,458,505 | B2 * | 12/2008 | Majima et al. | 234/98 |
| 2005/0223866 | A1 * | 10/2005 | Lee | 83/622 |

FOREIGN PATENT DOCUMENTS

| | | |
|---|---|---|
| JP | 2000-301492 | 10/2000 |
| JP | 2001-009791 | 1/2001 |
| JP | 2001-026370 | 1/2001 |
| JP | 2002-036196 | 2/2002 |
| JP | 2002-326196 | 11/2002 |

* cited by examiner

*Primary Examiner*—Edward Landrum
(74) *Attorney, Agent, or Firm*—Manabu Kanesaka

(57) ABSTRACT

A sheet hole-punching device includes a punch member having a leading end with a hole-punching blade, a base frame for movably supporting the punch member in a hole-punching direction, a drive motor for driving the punch member, and a transmission device for transmitting rotational force of the drive motor to the punch member so as to rotate the punch member. The transmission device is disposed between the drive motor and the punch member. A cam device is disposed between the base frame and punch member, and converts a rotational movement of the punch member into a hole-punching direction movement so as to move the punch member in the hole-punching direction while rotating the punch member.

4 Claims, 20 Drawing Sheets

DR I ;Direction of Rotation When Punching Holes in Odd-numbered Sheets
DR II ;Direction of Rotation When Punching Holes in Even-numbered Sheets

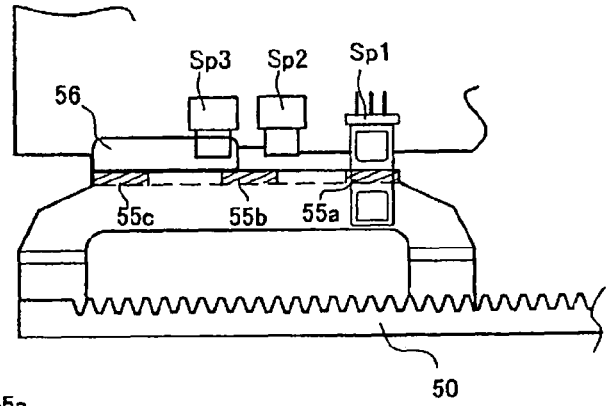
Fig. 7(a)
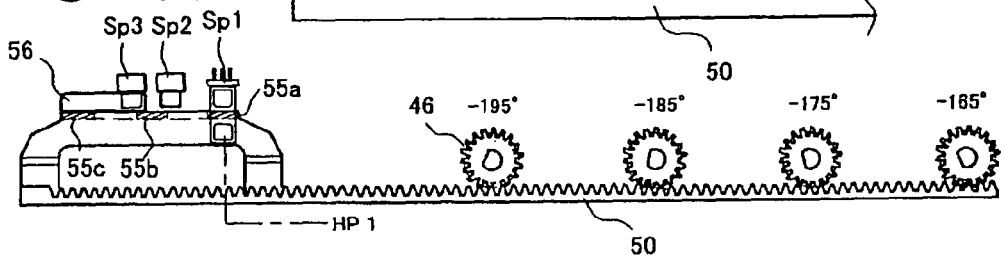
Fig. 7(b)
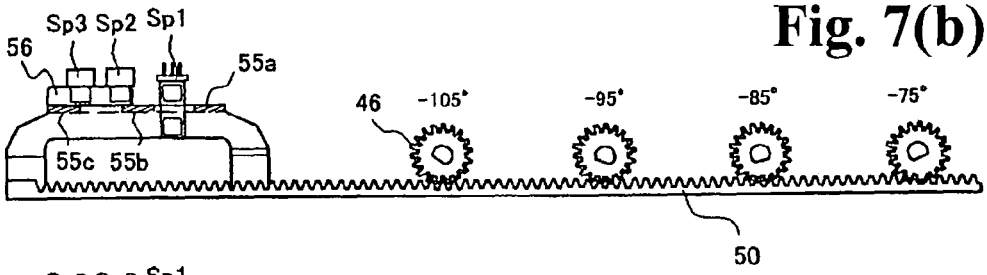
Fig. 7(c)
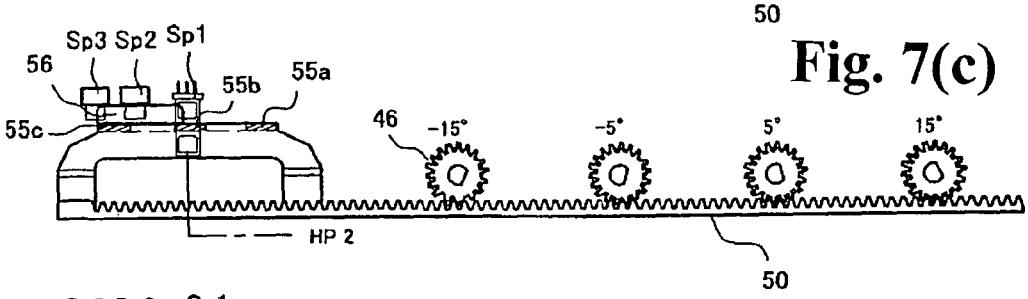
Fig. 7(d)
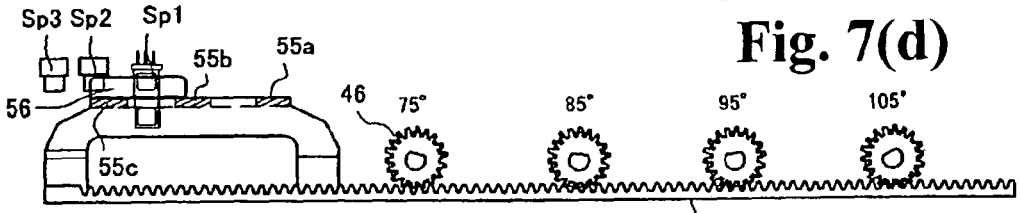
Fig. 7(e)
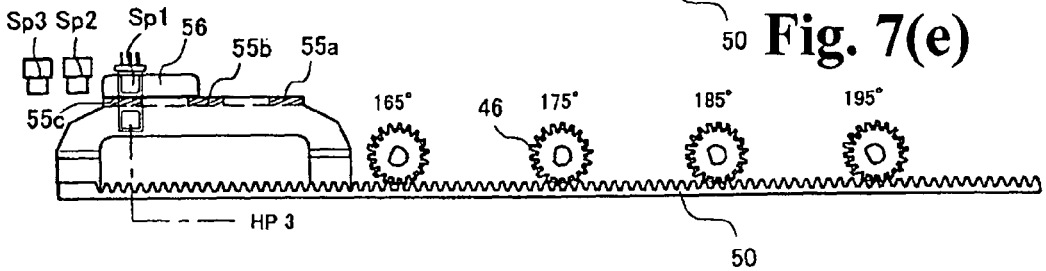

SHEET HOLE PUNCHING APPARATUS AND SHEET HOLE PUNCHING METHOD

BACKGROUND OF THE INVENTION

1. Field of the Invention

The present invention relates to a hole punching method, a hole punching device and a finishing apparatus, which are used in conjunction with image forming apparatuses, that punch holes in sheets conveyed out from an image forming apparatus such as a copier, printing machine or printer and the like.

2. Description of the Related Arts

Such a variety of hole-punching devices have been well known, as performing punch-holes in sheets by manually pushing hole-punching members downward into a plurality of sheets, and automatic hole-punching devices that punch holes in sheets conveyed out of a printing machine or copies as office devices for punching holes in paper. The former is widely known as a device for penetrating sheets by disposing cylindrically shaped punching members that shuttles up and down, on a frame member that sandwiches sheets. By pressing an operating lever downward, these cylindrically shaped hole-punching members penetrate the sheets thereby punching holes.

On the other hand, the latter method uses a drive motor to push punch members through sequentially conveyed out sheets that are set at a predetermined position. These are often incorporated into other devices. Both types of hole-punching devices can simultaneously punch holes in sheets at 2, 3 and 4 positions of predetermined distances. The number of holes and the distances therebetween are set to a uniform standard.

Conventional devices are disclosed in the Japanese Patent Publication Nos. 2001-9791, 2001-26370, 2000-301492, and 2002-326196. These publications disclose disposing an upper frame and a lower frame at a predetermined distance to sandwich sheets set therebetween. The upper frame supports a plurality of hole-punching members to move in up and down directions; the lower frame is formed with die punches (blade-bearing holes) that conform to the hole-punching members. A device is disclosed that uses a drive motor to move a plurality of hole-punch members in a hole-punching direction to punch holes in predetermined position of sheets. Depending on the standard, the plurality of hole-punching members can be selectively operated to punch two, three or four holes. Also, the load torque applied to the drive motor is reduced by delaying the operation of the selected plurality of punch members.

For that reason, each of the plurality of punch members is connected to the drive motor via cam means. The Japanese Pat. Pub. 1 engages a follower pin equipped on each of the punch members with a sliding cam having an upside-down V-shaped cam groove. The sliding cam is supported to move along the upper frame. A drive motor pinion is connected to a gear rack integrally formed on a portion of the sliding cam. Japanese Pat. Pub. 2 discloses connecting an eccentric cam to each hole-punching member composed of the same configuration described above. This eccentric cam is installed on a drive shaft disposed parallel to the upper frame. The drive shaft is connected to a drive motor. The eccentric cam of each punch member selectively punches holes in sheets depending on the rotational angle of the drive shaft. At the same time, a time difference is provided to the operation of the selected plurality of punch members to vary the hole-punching timing.

These Japanese Patent publications disclose a structure where the hole-punching members punch holes in a sheet in the process of moving from a top dead center to a bottom dead center of a thrusting direction, by receiving thrusting force in the hole-punching direction from the V-shaped cam or eccentric cam without rotating around a longitudinal axis of rotation.

When selectively moving the plurality of hole-punching members in the hole-punching direction using cam means as described in the aforementioned Japanese Patent publications, the hole-punching members are moved up and down in the shaft direction by engaging a follower pin integrally formed in the punch members with a sliding cam as described in Japanese Patent Pub. 1. They are also moved up and down by connecting the punch members 40 shaft to an eccentric cam, as described in Japanese Patent Pub. 2. These conventional hole-punching structures have the problems outlined below because hole-punching members are normally formed into a spindle-shape to punch holes in a sheet (or sheet bundle) by a thrusting action that is simply an up and down action.

First, a die having blade-bearing holes is disposed sandwiching the sheets for the punch members that move up and down. A paper cutting debris box is equipped below the die to collect paper cutting debris generated by punching holes in the sheets. In this conventional hole punching device structure wherein punch members move in the up and down direction in only the thrusting direction, paper cutting debris accumulates directly below the blade bearing holes. If the volume of paper cutting debris increases, there is the possibility that the cuttings can find their way into the device through the blade bearing holes. Particularly, when operating the punch and paper cutting debris accumulates into a pile directly below the punch members, a higher load than what is required is applied to the hole-punching members and an excessive load is applied to the drive motor. These loads can lead to mechanical failure. Also, if paper cutting debris on the die gets inside the device, there is the problem of incorrect sensing of the sheet sensor inside the device.

Secondly, with the hole-punching structure that punches holes in sheets using the thrusting action in up and down directions, another load is placed on the drive motor because a high shear strength is required to punch holes in the sheets. For that reason, when punching holes in sheets such as plastic film, or thick sheets, there is a large load placed on the drive motor. This means that the device must either have a large-capacity motor, or a high gear reduction ratio is needed to punch holes at low speed. Therefore, such devices have the particular problems of requiring a large drive unit and higher costs associated with punching holes.

SUMMARY OF THE INVENTION

The present invention provides a hole-punching method and hole-punching device that can store large volumes of paper cutting debris without the paper cutting debris entering the device, and without increased loads on the hole-punching blades, when punching holes in sheets such as with punch members.

The present invention further provides a hole-punching device that can punch holes at high speed without reduced shear load when punching holes and at the same time can be configured with a compact and lightweight drive mechanism.

The present invention employs the following configuration to solve the problems described above. A plurality (or one) of hole-punching members are disposed above a die plate (such as a die); each hole-punching member is configured to move between a top dead center and a bottom dead center. Drive means (a drive motor) is equipped to drive the punch members. A sheet is set on the die plate where holes are punched therein by the hole-punching members by moving from the top dead center to the bottom dead center. After holes are punched, the punch members return from the bottom dead center to the top dead center. After the hole-punching operation is ended, the finished sheet is conveyed out from the die plate. It should be noted that the punch members are configured not only to move up and down but also to rotate forward and reverse around a longitudinal axis of rotation (hereinafter referred to axis of rotation). Therefore, the hole-punching members punch holes in a sheet while rotating around the axis of rotation when moving the from the top dead center to the bottom dead center, and reverse the direction of rotation when recovering from the bottom dead center to the top dead center. Additionally, when continuously punching holes in a series of sequentially conveyed sheets, the directions of rotation change for the first sheet and a subsequent sheet.

By doing so, the hole-punching members 40 punch holes in a sheet while rotating around their axis of rotation when performing the hole-punching operation from the top dead center to the bottom dead center. Therefore, it is possible to notably reduce the shear force required in punching holes in a sheet. A smaller shear force makes it possible to employ a more compact and lighter weight drive motor. That also makes it possible to punch holes in sheets at a high speed. Because the hole-punching members change from a forward direction of rotation when punching holes to an opposite direction (reverse) when recovering or punching holes in the subsequent sheet, the centrifugal force generated by the rotation causes the paper cutting debris adhering to the cutter blades to be released from the blades.

Therefore, the hole-punching members rotate in the forward and reverse directions so paper cutting debris does not accumulate into a pile directly below the punch blades. Rather, that paper cutting debris is scattered in all directions so it accumulates substantially evenly in the cuttings box disposed below the punch members.

In this way, the present invention rotates the punch members around an axis of rotation when they are being driven to advance in a thrusting direction and when retreating. The directions of rotation are changed when the punch members are advancing in the thrusting direction, and when they are retreat. Specifically, when the punch members are advance from the top dead center to the bottom dead center, they are rotated in a clockwise direction, for example, and when retreating from the bottom dead center to the top dead center, they are rotated in the opposite direction. Also, the rotation directions are changed for a first sheet and a subsequent sheet.

Note that a cam means such as an eccentric cam connected to a drive motor causes this rotation, and cam means, such as an oblique cam, is provided on the punch members to rotate the punch members around the axis of rotation when they are being driven in the thrusting direction, and when retreating.

A sliding member (gear rack) that advances and retreats with a predetermined stroke, a drive motor that eciproactively moves the sliding member, punch members that are rotated around the axis of rotation by the movement of the sliding member and cam means (such as an oblique cam) that convert the rotation of the punch members into a thrusting action cause the punch members to move up and down in a thrusting direction while they are rotated around their axis of rotation.

A sliding member (sliding cam) that advances and retreats with a predetermined stroke, a drive motor that moves the sliding member, punch members that are moved in the thrusting direction by the reciprocating action of the sliding member and cam means (such as an oblique cam) that convert the rotation of the punch members into a thrusting action cause the punch members to move up and down in a thrusting direction while they are rotated around their axis of rotation.

BRIEF DESCRIPTION OF THE DRAWINGS

FIG. 2(*a*) is a sectional view; FIG. 2(*b*) is an example variation.

FIG. 3(*a*) is a perspective view; FIG. 3(*b*) is a circular cam expanded in plan view.

FIG. 6(*a*) is a plan view; FIG. 6(*b*) is a sectional view.

FIGS. 7(*a*) to 7(*e*) are explanatory diagrams showing operations of the position sensor shown in FIGS. 6(*a*) and 6(*b*).

FIG. 8(*a*) shows an obliquely cropped blade; FIG. 8(*b*) shows a V-shape blade.

FIG. 9(*a*) shows a drive mechanism; FIG. 9(*b*) is a configuration of a drive cam.

FIG. 14(*b*) is an expanded view of the essential portion thereof.

DETAILED DESCRIPTION OF THE PREFERRED EMBODIMENTS

Figure 1:
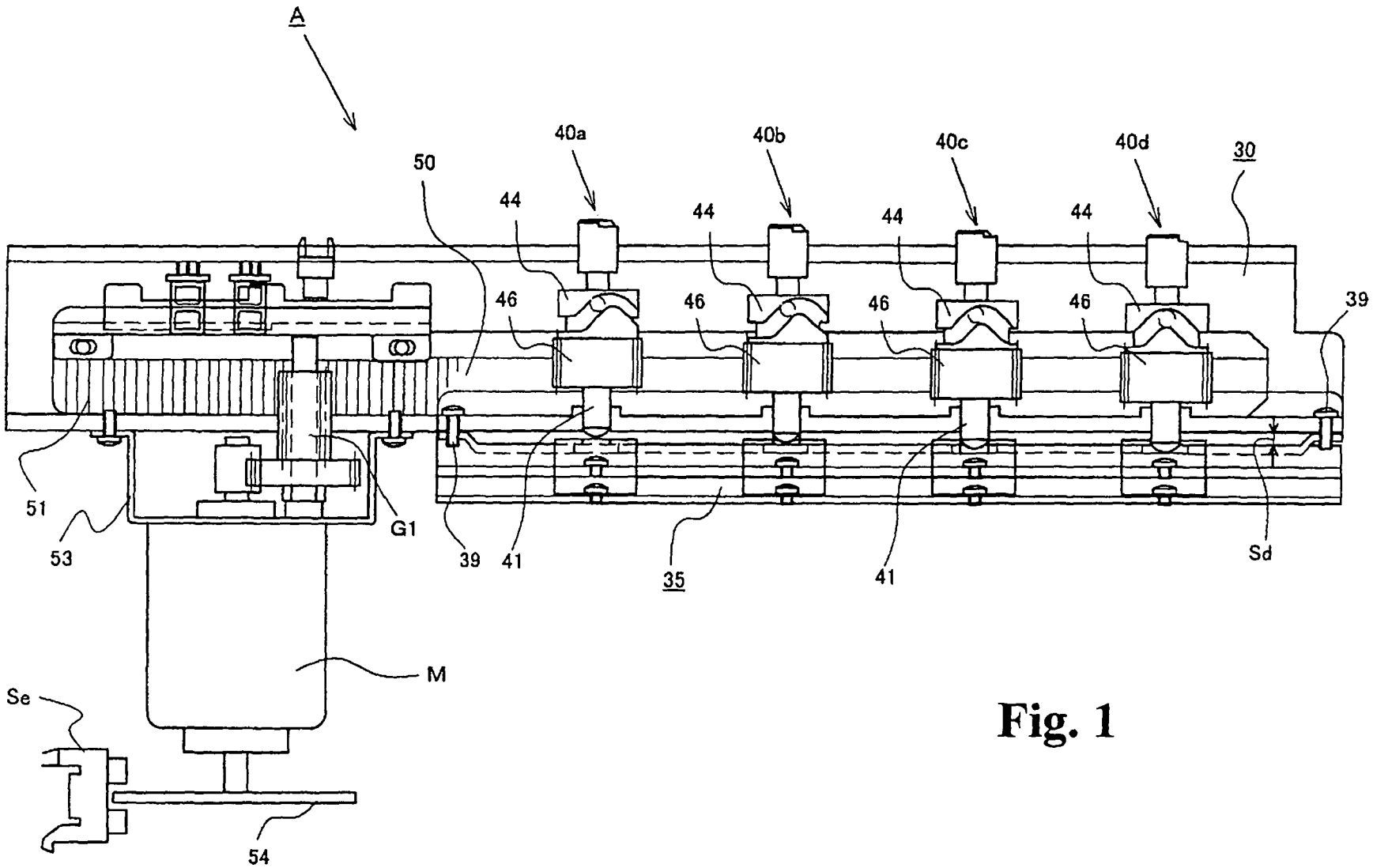
FIG. 1 shows an overall configuration of one embodiment of the hole-punching device according to the present invention.
Figure 2A:
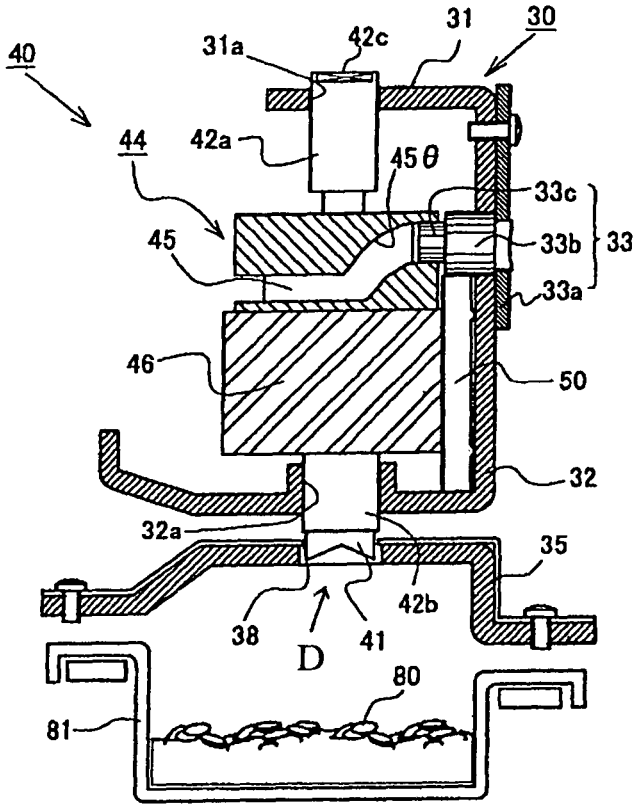
FIGS. 2(*a*) and 2(*b*) are views of the essential portions of the device shown in FIG. 1.
Figure 2B:
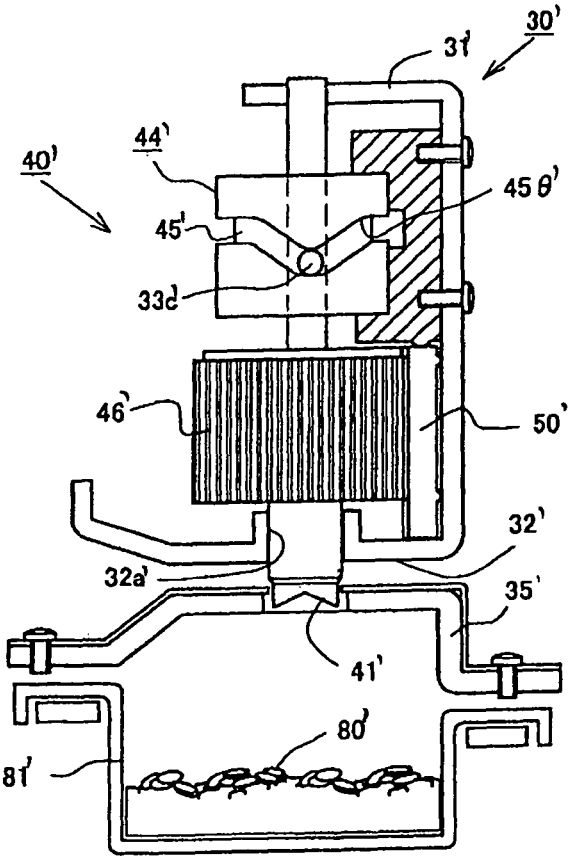
Figure 3A:
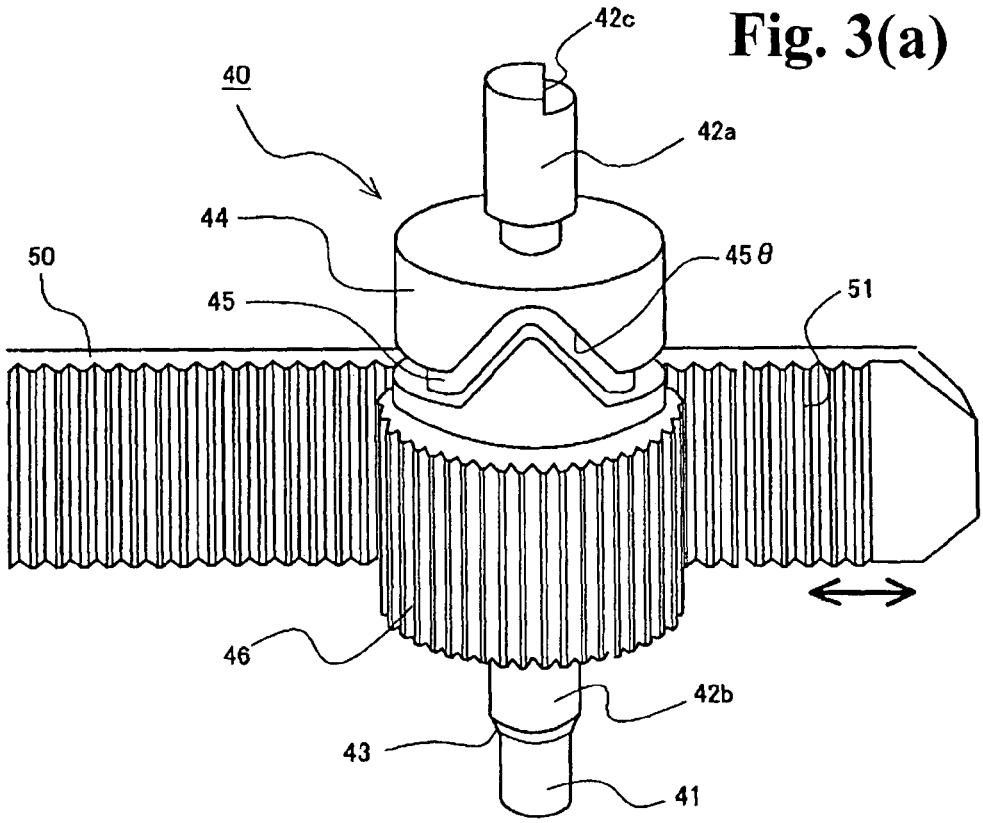
FIGS. 3(*a*) and 3(*b*) are views of cam means of the apparatus of FIG. 1.
Figure 3B:
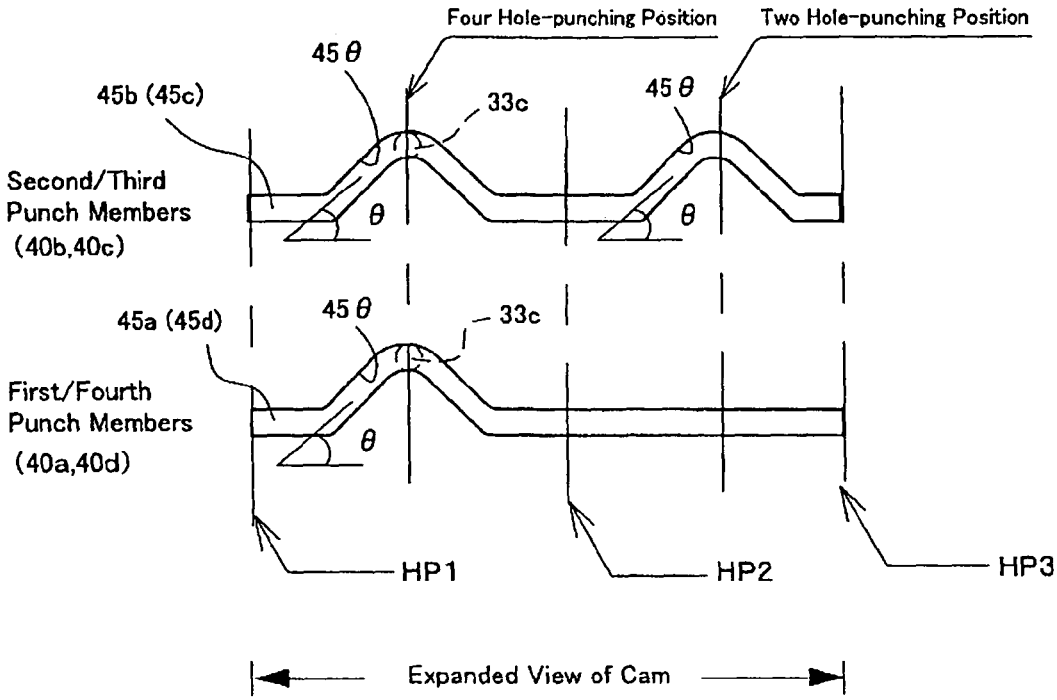
Figure 4:
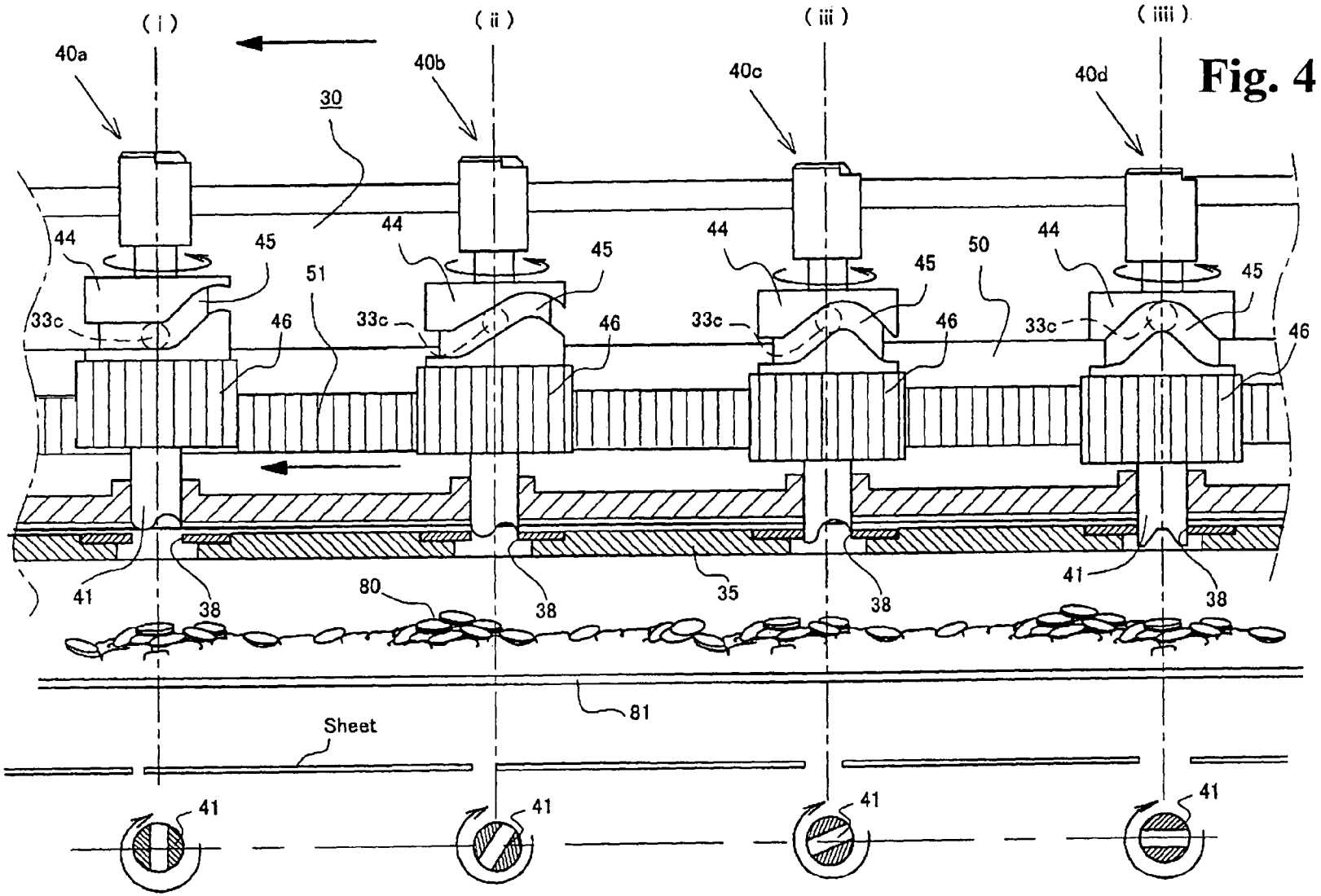
FIG. 4 is an explanatory diagram shown operation of the hole-punching device shown in FIG. 1.

Preferred embodiments of the present invention will now be explained with reference to the drawings provided. FIG. 1 is an explanatory view of the overall configuration of a hole-punching device A according to the present invention; FIGS. 2(*a*) and 2(*b*) are sectional views of the essential parts thereof. FIG. 3(*a*) is a perspective view of a punch member; 3(*b*) is an explanatory view of oblique cams. FIG. 4 is an explanatory drawing of operating states when punching holes with the device shown in FIG. 1.

Figure 5:
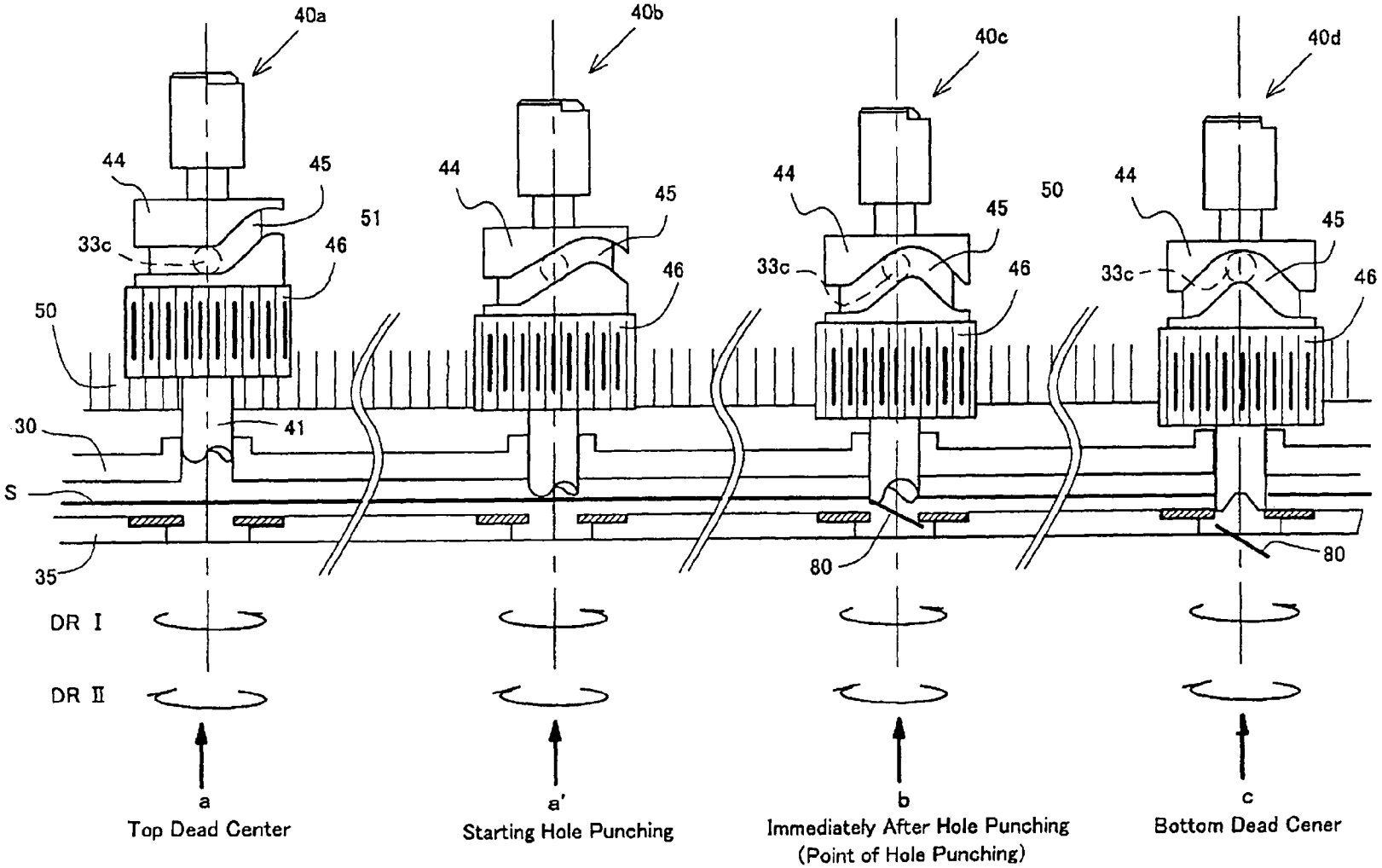
FIG. 5 is an explanatory drawing of operating states when punching holes with the device shown in FIG. 1.

The following will initially explain the fundamental configuration of the hole-punching method and hole-punching device according to the present invention. As shown in FIG. 5, punch members 40 are configured to move up and down between a top dead center and a bottom dead center relative to a sheet die plate (hereinafter referred to as a die plate) 35 where a sheet is set. Each punch member 40 is equipped with a cylindrically shaped hole-punching blade 41 at a leading end and is supported on a device frame (a base frame described below) to allow movement in up and down directions. Either linear force is applied to the punch members 40 in a thrusting direction (a vertical direction of FIG. 5), or a rotational drive force is applied to the punch members 40 to rotate around their longitudinal axis, or their axis of rotation (circumferential direction of FIG. 5). Drive force is applied by a transmission means connected to a drive motor M.

Therefore, the present invention can apply either linear motion in the thrusting direction, or rotary motion to the punch members 40 supported to allow reciprocating movement between the top dead center and the bottom dead center as described above. The cam groove 45 (67) including the oblique cam surface 45θ (67θ) set to a predetermined angle with respect to the thrusting direction, is disposed between the punch members 40 and the device frame 30, and is engaged by the cam follower member 33*c* (65). This cause the punch members 40 to move in the thrusting direction from the top dead center to the bottom dead center while they are being rotating around their axis of rotation.

The following will explain the action of the punch members 40 with reference to FIG. 5. The punch member 40 positioned at the top dead center of the arrow a (far left of FIG. 5) receives drive force causing it to move downward where a blade on the leading end touches the sheet S. As the punch member 40 is being rotated in the clockwise direction, it moves downward toward the bottom dead center. At the hole-punching point shown at arrow b, the hole-punching blade 41 of the punch member 40 penetrates the sheet S while the punch members 40 is being rotated in the clockwise direction. It then reaches the bottom dead center of arrow c. At this time, the shearing force applied to the sheet S while the punch member 40 is being rotated is reduced (30% to 40% in tests of this device). Therefore, if the hole-punching speed is the same from the top dead center a to the bottom dead center c, the drive load is reduced several tens of percentages; conversely, if the drive loads are the same, the hole-punching speed can be higher of several tens of percentages.

Paper cutting debris 80 adheres to the leading ends of the punch members 40 when the punch members 40 penetrate the sheet S at the hole-punching point b. The paper cutting debris 80 separates from the punch members 40 and falls downward, but if the sheet material is elastically deformable, such as plastic film, the cutting debris 80 has a tendency of continuing to adhere to the blades at the leading ends of the punch members 40. In such cases, the punch members 40 use centrifugal force to fling the paper cutting debris 80 adhering to the punch members 40 when they rotate in the clockwise direction as they move from the top dead center to the bottom dead center, and vice-versa.

The present invention securely scatters paper cutting debris 80 that separates from the punch members 40 by reversing the rotating of the punch members 40 from the clockwise direction to the counterclockwise direction.

Also, the paper cutting debris 80 is thrown in all directions from the punch members 40 that rotate in the clockwise and counterclockwise around the axis of rotation. For example, as shown in FIG. 2(*a*), the paper cutting debris 80 accumulate substantially uniformly in a cutting container such as a cuttings box 81 disposed below the die plate 35. Because the cutting debris is thrown randomly in various directions the debris does not accumulate to form a pile directly below the hole-punching blades 41. Therefore, the cuttings box 81 can be formed into a flat, and thin shape to be able to be incorporated into a limited space of a sheet conveyance unit of an image forming apparatus, finisher, or bookbinding apparatus and the like, for example. In this case, it is not necessary to frequently remove the paper cutting debris 80.

The first, second and third embodiments of the hole-punching device A according to the present invention will now be explained in that order.

First Embodiment of the Hole-Punching Device

The following will explain the hole-punching device A shown in FIG. 1. The hole-punching device A is composed of a base frame (hereinafter referred to as the upper frame) 30 having a length dimension that corresponds to the sheet S that is to be punched with holes; a lower frame (hereinafter referred to as the die plate) 35 forming a space Sd with the upper frame 30 for setting the sheet S; punch members 40 installed in the upper frame 30; and blade bearing holes 38 disposed in the lower frame 35. The punch members 40 are formed into ordinary cylindrical shapes; a hole-punching blade 41 is disposed on each of the leading ends of the punch members 40. These punch members 40 are disposed at predetermined standard (standard for filing holes) position on the upper frame 30. There can be two, three or even four of these punch members 40. Shown in the drawing are a first punch member 40*a*; a second punch member 40*b*; a third punch member 40*c*; and a fourth punch member 40*d* disposed at four locations.

Each punch member 40*a* to 40*d* has the same structure, so only one will be explained in detail below. As shown in FIG. 2(*a*), the upper frame 30 is composed of a sectional U-shaped channel member, and guide holes 31*a* and 32*a* are disposed at an upper guide 31, and a lower guide 32 that vertically oppose each other. An upper shaft unit 42*a* is matingly supported by the guide hole 31*a*, and a lower shaft unit 42*b* is matingly supported by the guide hole 31*b*, on the punch member 40. Therefore, the punch member 40 is supported on the upper frame 30 to slide in up and down directions (downward being the hole-punching direction) of FIG. 2(*a*).

The blade bearing hole 38 that conforms to the hole-punching blade 41 is provided on the lower frame 35. The aperture D of the blade bearing hole 38 has a relationship of $D=d+\alpha$ ($\alpha$ being a gap) to form a minimum tolerance space (gap) with the aperture d of the hole-punching blade 41. A shoulder-shaped level 43 is formed on the punch members 40. This gap formation will be described later. The lower frame 35 is integrally mounted by fixing screws 39 to form the space Sd, described above, with the upper frame 30; the upper frame 30 and lower frame 35 forming a unit.

Cam means (cylindrical cam in the drawings) 44 is integrally disposed on the punch members 40. A cam groove 45 having an oblique cam surface 45θ is formed around the circumference of the cylindrical cam 44. The cam means composed by the cylindrical cam 44 composes momentum transfer means that converts drive force applied to the punch members 40 as described below, in a thrusting direction and rotating directions.

A cam follower member 33 that engages the cam groove 45 is fastened to the upper frame 30. The cam follower member 33 shown in the drawing is equipped with a base 33*a*, guide shaft 33*b*, and cam engaging portion (hereinafter referred to as a lead pin) 33*c*. The base 33*a* that mates with the engaging hole formed in the upper frame 30 is fastened by a screw or the like to have a predetermined positional relationship with the guide holes 31*a* and 32*a*. The guide shaft 33*b* guides the sliding member 50, described below; the lead pin 33*c* is composed of a pin-shaped member that engages the cam groove 45. Therefore, the punch member 40 is supported on the upper frame 30 to slide in up and down directions; the cam groove 45 engages and holds the lead pin 33*c* equipped on the frame. This lead pin 33*c* composes the cam follower member.

A passive gear 46 is integrally installed on the punch member 40. This passive gear 46 is connected to a drive motor M, described below, via a transmission means (gear rack) 51. Punch members 40 are composed by the hole-punching blade 41 and upper and lower shafts 42*a* and 42*b* with an easily grindable material such as a SUS type steel material. It is also acceptable to form the punch members 40 using other metals or ceramics. Also, the cylindrical cam 44 and passive gear 46 are formed by a synthetic resin such as POM (Duracon resin), but the material is not particularly limited to any one kind. Any material that is formable and quiet can be adopted.

The hole-punching blade 41 of the punch members 40, the cylindrical cam 44 and the passive gear 46 are integrated. These three members have been integrated to enable them to rotate as one body. When forming them, they are fastened by integrating them by insertion molding, fixing screws or by adhesive. For example, the shaft portion of the punch members 40 can be formed in to non-cylindrical shape in the cross-section (for example, a square shaft, or a D-shaped shaft), and the cylindrical cam 44 and passive gear 46, formed by resin into a unitized member, are pressed onto that. If required, they can be fastened to the shaft by fixing screws of adhesive. Note that the shape of the cam groove 45 formed to cylindrical cam 44 is described below.

Figure 8A:
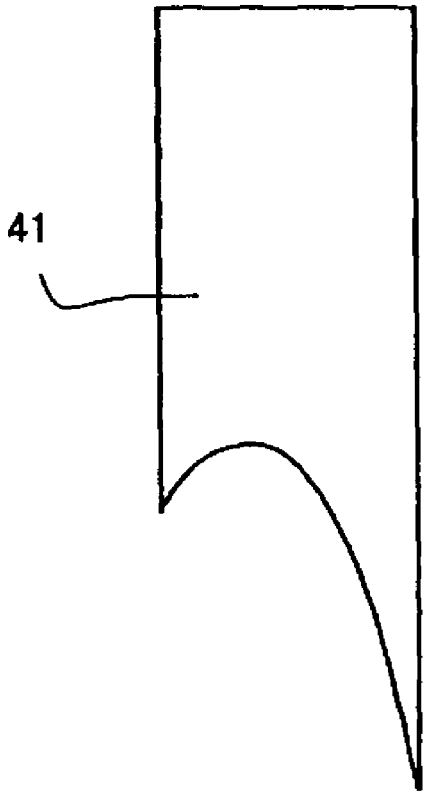
FIGS. 8(*a*) and 8(*b*) show shapes of hole-punching blades.
Figure 8B:
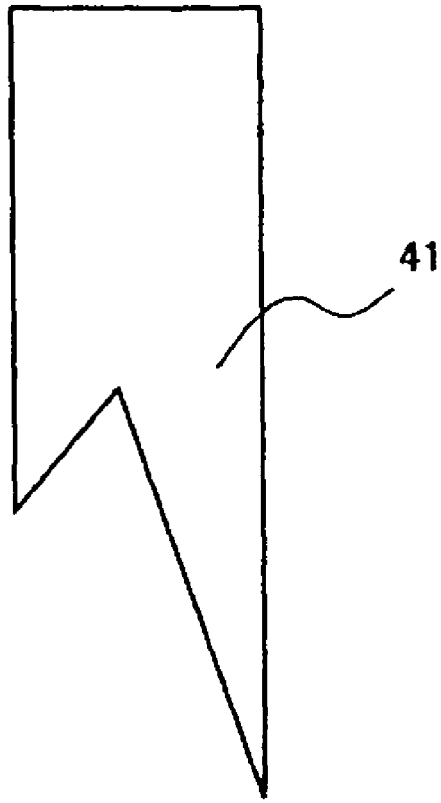

The shape of the leading end surface of the hole-punching blade 41 disposed on each of the leading ends of the punch members 40 is cut to form a wave, such as a sectional U-shape or V-shape, as shown in FIGS. 8(*a*) and 8(*b*). The end surface that touches the sheet S is formed into a concave/convex shape. This is to form a sharp leading end of the hole-punching blade 41 that penetrates the sheet S, and to increase the shear force when punching a hole while the punch members 40 is rotated around the axis of rotation. Furthermore, as shown in FIG. 8(*b*), the shape of the hole-punching blade 41 is configured so that one edge is an obliquely cropped shape. The tip is pointed into a sharp leading end to enable it to further increase the shearing action when punching holes. The blade shown in FIG. 8(*a*) is obliquely cropped; the blade shown in FIG. 8(*b*) is a V-shape with one edge formed to a sharp point.

The sliding member 50 is incorporated into the upper frame 30 to move in the left and right directions of FIG. 1.

The gear rack 51 is formed on the sliding member 50. The gear rack 51 mates with each of the passive gears 46 of the plurality (4 places are shown in the drawing) of punch members 40*a* to 40*d* disposed on the upper frame 30. The sliding member 50 is guided to slide in up and down directions between the guide shaft 33*b* of the cam follower members 33 described above, and the lower guide 32, and is guided to the front and back directions (see FIG. 2(*a*)) between the backside of the upper frame 30 and each passive gear 46. The sliding member 50 is also supported to move in the left and right directions of FIG. 1. This causes the passive gears 46 of the punch members 40*a* to 40*d* and the gear rack 51 of the sliding member 50 to mate, thereby rotating the punch members 40 at a predetermined angle (phase difference described below) corresponding to the amount of movement of the sliding member 50.

A drive motor M is connected to the sliding member 50 as described below. The drive motor M is mounted to the upper frame 30 by a bracket 53; drive gear G1 is connected to the motor rotating shaft via a reduction gear. The drive gear G1 mates with the gear rack 51 of the sliding member 50. Therefore, the sliding member 50 moves in the left and right directions of FIG. 1 by the forward and reverse drive of the drive motor M. Note that the number 54 in the drawing is an encoder provided on the rotating shaft of the drive motor M; Se is an encoder sensor that detects the encoder.

Figures 6A, 6B:
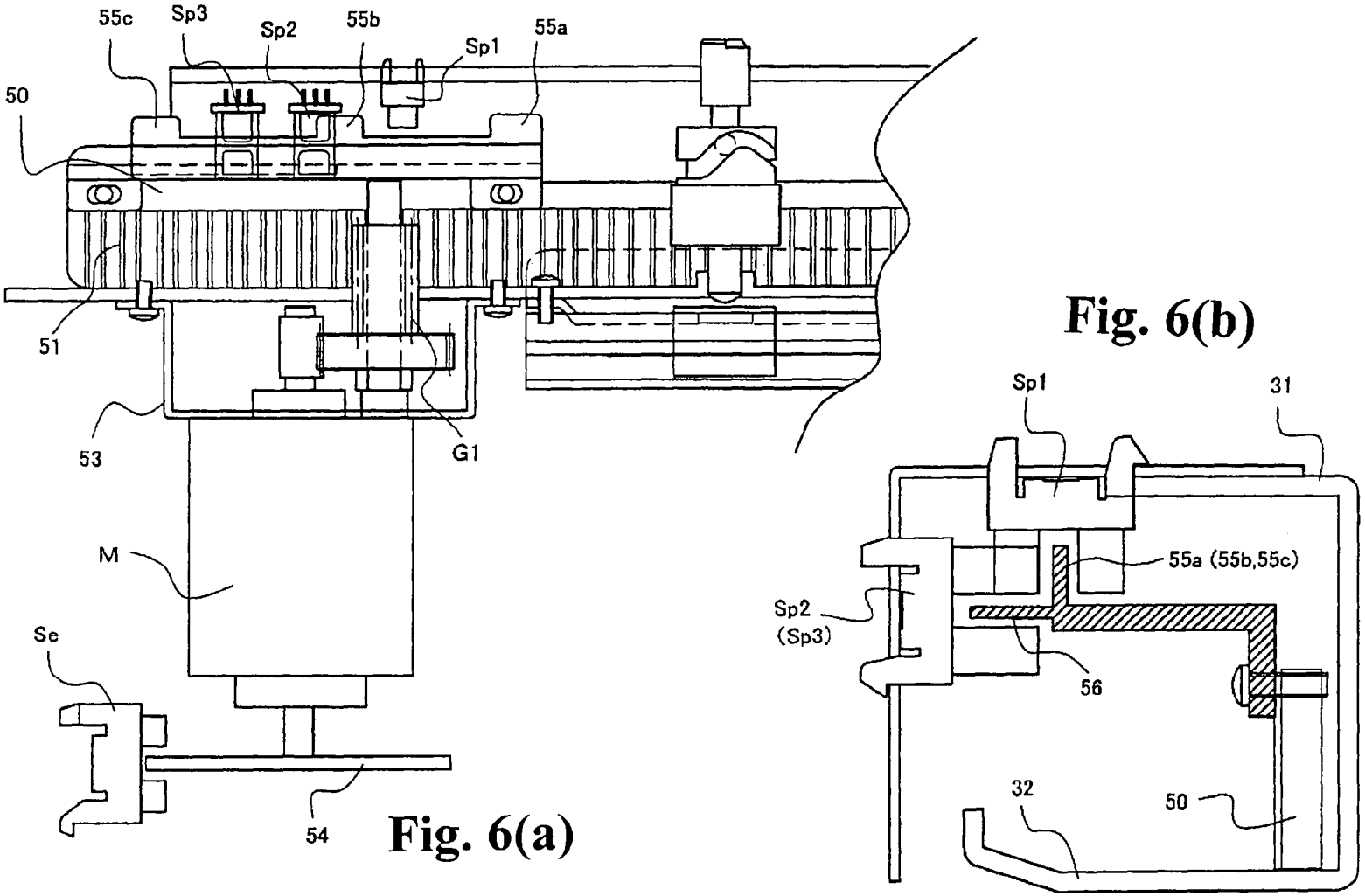
FIGS. 6(*a*) and 6(*b*) show a configuration of a drive mechanism position sensor apparatus shown in FIG. 1.

A position sensor is disposed on the sliding member 50 to detect its position. As shown in FIGS. 6(*a*) and 6(*b*), first sensor flags 55 (55*a*, 55*b*, 55*c*) and a second sensor flag 56 are equipped on the sliding member 50. A first position sensor Sp1 detects the first sensor flags 55*a* to 55*c*; A second position sensor Sp2 and a third position sensor Sp3 detect the second sensor flag 56. The position sensors Sp1 to Sp3 will be explained below.

The following will now explain the cam groove 45 of the punch members 40 configured as described above. The cam groove 45 is provided as shown in FIGS. 3(*a*) and 3(*b*) on the cylindrical cam 44 disposed on the punch members 40*a* to 40*d* as described above. The drawing shows a configuration that punches holes in the sheet S by selecting either two or four holes. With this relationship, same-shaped cam grooves 45*a* and 45*d* are formed in the outer circumference of each cylindrical cam 44 of the first punch member 40*a* and fourth punch member 40*d*; same-shaped cam grooves 45*b* and 45*c* are formed in the outer circumference of each cylindrical cam 44 of the second punch member 40*b* and third punch member 40*c*.

An oblique cam surface 45θ that is inclined to a predetermined angle (θ) with regard to the hole-punching direction is provided on each of the cam grooves 45*a* to 45*d*. The oblique cam surface 45θ is formed at one location in the first and fourth cam grooves 45*a* and 45*d*, and at two locations in the second and third cam grooves 45*b* and 45*c*. (See FIG. 3(*b*).) The oblique cam surface 45θ of the first and the fourth cam grooves 45*a* and 45*d*, and one of the oblique cam surfaces 45θ of the second and the third cam grooves 45*b* and 45*c* are disposed at the same angle position (first angle position) of each cylindrical cam 44, enabling the punch members 40 to punch four holes in the sheet S at the first angle position.

The other oblique cam surfaces 45θ of the second and third cam grooves 45*b* and 45*c* are formed to the same angle position at an angle position (second angle position) that is different from the first angle position of the cylindrical cam 44, enabling the punch members 40 to punch only two holes in the sheet S at the second angle position. The first and fourth cam grooves 45*a* and 45*d* are formed to a horizontal, linear groove in the circumference direction of the cylindrical cam 44, at the second angle position. Therefore, because the first to the fourth cam grooves 45*a* to 45*d* engaged by the lead pin 33*c* fastened to the upper frame 30 disposed as described above, the first to the fourth punch members 40*a* to 40*d* punch four holes in the sheet S at the first angle position, and the second and third punch members 40*b* and 40*c* punch only two holes in the sheet S at the second angle position.

Each of the cylindrical cams 44 is mounted to the upper frame 30 to have predetermined angles and phase differences. The timing for the punch members 40*a* to 40*d* to punch holes when punching holes is varied. In other words, as shown in FIG. 1, when punching four holes, the timing for punching holes is shifted for each of the punch members 40*a* to 40*d* with a time difference (cam groove transition difference) for the first punch member 40*a*, the second punch member 40*b*, the third punch member 40*c*, and the fourth punch member 40*d*. When punching only two holes, the second punch member 40*b* and the third punch member 40*c* also have a phase difference. The drawings show that the upper shaft 42*a* of each of the punch members 40*a* to 40*d* is formed to a D-shape groove 42*c* to form such a phase difference. There is also a positioning marker (not shown) provided on the circumference of the guide hole 31*a* formed on the upper frame 30. This marker rules the reference angle position of each cylindrical cam 44 on the upper guide 31 of the upper frame 30 by printing or other means.

The control of operations of the punch members 40 described above will now be explained. The first sensor flags 55, and the second sensor flag 56, and first position sensor Sp1, second position sensor Sp2, and third position sensor Sp3 that detect those sensor flags are equipped on the sliding member 50. The encoder 54 and encoder sensor Se are disposed on the drive motor M. As shown in FIG. 6(*a*), the first sensor flag 55 is composed of three flags 55*a*, 55*b*, and 55*c* disposed on the sliding member 50 at equal distances. These flags 55*a* to 55*c* are disposed with a positional relationship for the first position sensor Sp1 to detect whether the punch members 40 have punched holes in the sheet S. The second sensor flag 56 is disposed on the sliding member 50 at a position opposing the second and third position sensors Sp2 and Sp3.

The first and second sensor flags 55 and 56, and position sensors Sp1 to Sp3 are disposed with the positional relationships shown in FIG. 7. In the state shown in FIG. 7(*a*), the first position sensor Sp1 is ON; the second position sensor Sp2 is OFF, and the third position sensor Sp3 is ON. This detects right limit position of the sliding member 50, and the home position HP1 (starting position and ending position) when punching four holes. Specifically, the right limit position is detected when the sliding member 50 is moved to the right side of the drawing by the drive motor M, the drive motor M stops and the sliding member 50 returns. When the sliding member 50 is moved to the left side of the drawing, the home position HP1 (starting position and ending position) to punch four holes is detected at that position. The amount of rotation of the drive motor M is controlled based on this position.

Note that whether the sliding member 50 moves right to left, or left to right is determined either by the order of movement of the position sensors Sp1 to Sp3, or by the encoder equipped on the drive motor M. In the state shown in FIG. 7(*b*), the first position sensor Sp1 is OFF; the second position sensor Sp2 is ON, and the third position sensor Sp3 is ON. This detects the four hole-punching operating position. In this state, the punch members 40*a* to 40*d* have ended the punching of holes in the sheet S.

In the state shown in FIG. 7(*c*), the first position sensor Sp1 is ON; the second position sensor Sp2 is ON, and the third position sensor Sp3 is OFF. This detects the four hole-punching ending position. At this position, the home position HP2 (operation starting reference position) when punching two or four holes is detected. Specifically, when punching two or four holes, the sliding member 50 is controlled based on this home position HP2. When punching four holes based on this home position HP2, the sliding member 50 moves to the left side of FIG. 7; and when punching two holes, the sliding member 50 moves to the right side of that drawing. Next, when the first position sensor Sp1 is OFF; the second position sensor Sp2 is OFF, and the third position sensor Sp3 is OFF, shown in FIG. 7(*d*), the two hole punching operating is detected. In this state, the punch members 40*b* and 40*c* end punching holes in the sheet S.

Next, when the first position sensor Sp1 is ON; the second position sensor Sp2 is OFF, and the third position sensor Sp3 is OFF, shown in FIG. 7(*e*), the home position HP3 (ending position of the two hole punching operating) is detected. Specifically, when punching two holes, after the drive motor M stops when this state is detected, the rotation is reversed. Note that the encoder equipped on the drive motor M obtains the timing signal to control the rotation of the drive motor M by detecting the amount of rotation of the rotating shaft of the drive motor M. More specifically, the drive motor M moves the sliding member 50 between the home position HP1 when punching four holes, by moving to the left side of FIG. 7, based on the home position HP2. Also, when punching two holes, the sliding member 50 is moved between the home position HP3 to the right side of the drawing, based on the home position HP2.

Figure 12:
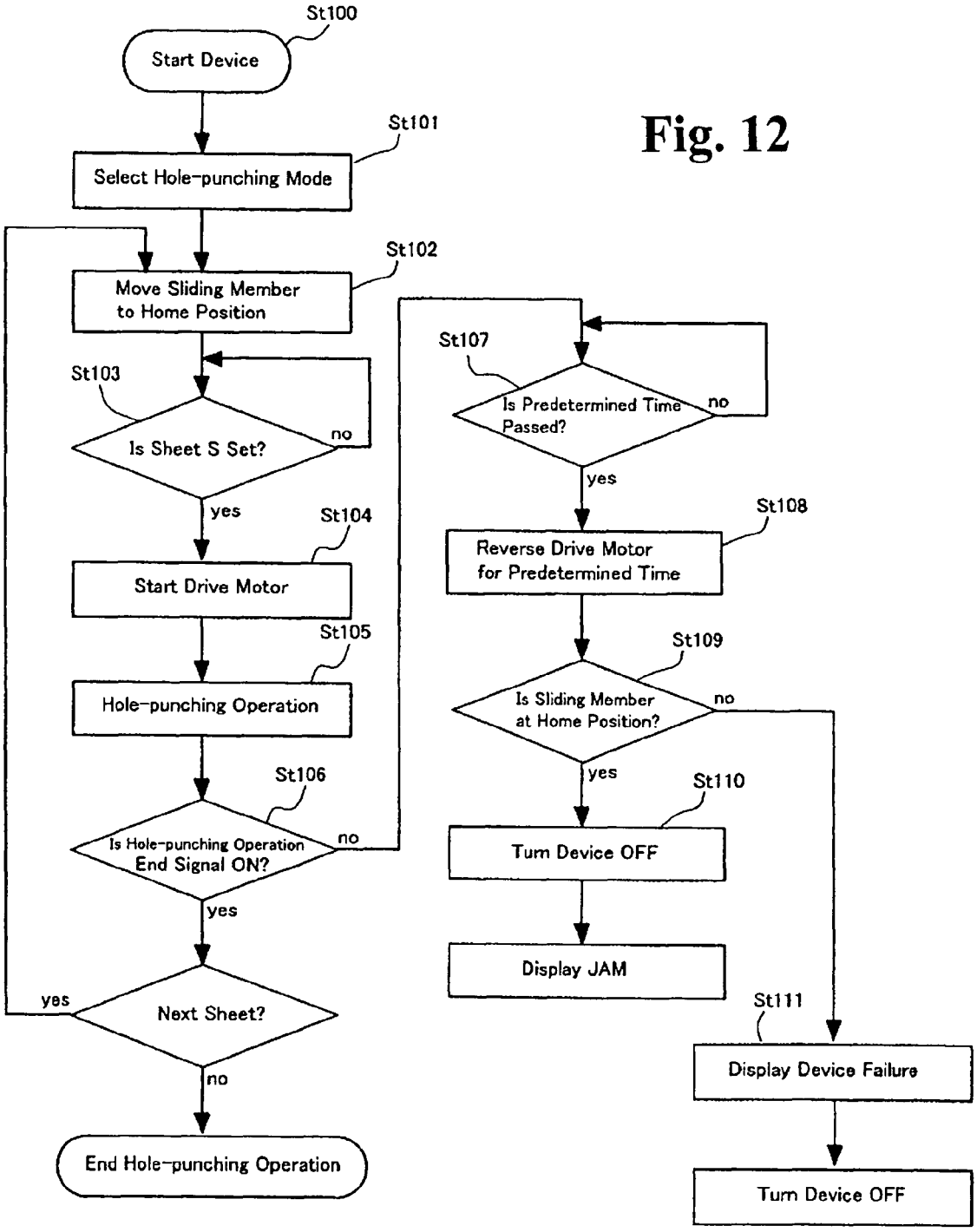
FIG. 12 is a flowchart showing the control of the hole-punching device according to the present invention.

The operations for punching two or four holes in the sheet S, such a paper and the like, using the device described above are explained below. Control means, not shown, such as a control CPU, is provided on the hole-punching device A. The following will now explain the operations of the control CPU (control means) with reference to the flow chart of FIG. 12.

Power is turned on for the device. When the device starts (St100), the control means receives a two-hole or a four-hole hole-punching mode selection signal (St101) from a finisher apparatus C, or the like. The control means moves the sliding member 50 to the home position (starting position) at an instruction signal. (St102) Movement to the home position means to move to the home position HP2 (reference position). At this time, the control means rotates the drive motor M in the reverse direction from the home position HP2 after overlapping a predetermined amount. When this occurs, the sliding member 50 is positioned at the home position HP2 shown in FIG. 7(*c*) without backlash. In this state, the control means stops the drive motor M and waits for the sheet S to be conveyed and set.

Next, when the sheet S is ready at the predetermined setting position, the control means drives the drive motor M to move the sliding member 50 in the right direction of FIG. 7 (St104) at the setting end signal (St103). When the sliding member 50 moves in the right direction, the gear rack 51 integrated thereto rotates the passive gear 46 in the counterclockwise direction. When this occurs, the punch members 40 move in the punching direction (the thrusting direction) while being rotated in the counterclockwise direction from the state of (i) in FIG. 4, to (ii), (iii), then (iiii). In this process, four or two holes are punched in the sheet S. (St105)

Next, the control means determines whether the hole-punching operation is ended using the first position sensor Sp1 to third position sensor Sp3 (Sp1 is OFF; Sp2 and Sp3 are both ON or OFF) (St106) At this time, if a preset jam time is passed and the operation ending position is not detected by the sensor, a jam is determined and the drive motor M is rotated in reverse. (St108) With the reverse rotation of the drive motor M, the sliding member 50 and the punch members 40 return back to the home position HP2. This is detected by the first and second position sensors Sp1 and Sp2. (St109) Here, the control means issues a jam signal and displays "Jam" on the control panel of the finishing apparatus C. At the same time, the device power is turned OFF. (St110)

If the sliding member 50 and the punch members 40 do not return back to the home position HP2 with the reverse rotation of the drive motor M, it is considered that a device failure has occurred. The CPU issues an error signal and displays "Device Failure" on the control panel. (St111) If the punching of holes in the sheet S has been executed normally, the control means issues the hole punching end signal to the finisher apparatus C, for example, and the finisher apparatus C conveys the sheet S from the predetermined setting position to outside the device. About the time that the sheet S is conveyed out, the control means rotates the drive motor M in the reverse direction to recover the sliding member 50 back to the home position HP2. In this state, the device waits for the next sheet S to be prepared at the setting position.

In such a method, the present invention rotates the hole-punching blades 41 around the axis of rotation simultaneously to their being moved in the thrusting direction (see (i), (ii), (iii) (iiii) in FIG. 4) in that order to move the punch members 40 from the home position HP to the hole-punching position, to punch holes in the sheet S. For this reason, the shear force of the hole-punching blades 41 exerted onto the sheet S is increased several times compared to moving the hole-punching blades 41 simply in the thrusting direction.

An explanation was provided for the device wherein an oblique cam surface 45θ is formed in the cylindrical cam 44 integrated to the punch members 40, and a cam follower member 33 is disposed on a base frame 30. Note that it acceptable to configure the cam means and cam follower means to an opposite configuration. An example of this is provided in FIG. 2(*b*). The following will now explain such a configuration using the same symbols as those used in relation to FIG. 1. The lead pin 33*c*' that composes the cam follower member is integrated by being inserted into the shaft of the punch members 40', and the semi-circular cylindrical cam 44' formed by the oblique cam surface 45θ' is fastened to the upper frame 30' by screws, or the like. Other configurations are the same as those shown in FIG. 1; explanations thereof will be omitted from the explanation that follows. Even with the configuration of that shown in FIG. 2(*b*), the punch member 40' is moved in the thrusting direction while being rotated around the axis of rotation, in the same way as was described above, to punch holes in the sheet S.

Therefore, as shown in FIG. 5, the punch members 40 guided by the lead pin 33*c* along the oblique cam surface 45θ are moved from the top dead center a to the punching starting position a' while being rotating in the counterclockwise direction. The hole-punching blade 41 touches the sheet S to begin punching the hole along with the movement of the sliding member 50 that includes the gear rack 51. The hole-punching blade 41 penetrates the sheet S as the punch member 40 rotates in the same direction, and moves to the punching ending position b. Next, it moves to the bottom dead center c. Next, the sliding member 50 moves further to move the punch members 40 from the bottom dead center c in the top dead center a direction. At this time, the punch member 40 guided by the lead pin 33*c* along the oblique cam surface 45θ returns to the upper punching ending point b while being rotated in the counterclockwise direction to return further to the hole punching starting position a', and recovering to the final top dead center a.

When punching holes in a subsequent sheet S, the sliding member 50 is moved in the counterclockwise direction so the punch members 40 repeat the same operation while rotating in the clockwise direction. Specifically, when sequentially punching holes in an odd-numbered sheet S, the punch members 40 rotate in the clockwise direction and move from the top dead center a to the bottom dead center c, and while rotating later in the same direction, move from the bottom dead center c to the top dead center a. Then, when punching holes in an even-numbered sheet S, the punch members 40 rotate in the opposite direction and move from the top dead center a to the bottom dead center c, and then recover from the bottom dead center c to the top dead center a.

Therefore, if paper cutting debris 80 adheres to the leading edge of the hole-punching blade 41, it will be thrown by that rotation when punching holes, or it will be thrown by the rotation in the opposite direction when punching holes in a subsequent sheet. The paper cutting debris 80 adhering to the hole-punching blade 41 is separated from the leading edge of the blade by the centrifugal force of the forward and revere rotations of the blade. The debris 80 is thus thrown in every direction, so it accumulates substantially evenly in the cuttings box 81 disposed below the lower frame 35.

Second Embodiment of the Hole-Punching Device

A different embodiment of the device shown in FIG. 1 will now be explained with reference to FIGS. 9(*a*) and 9(*b*) and 10(*a*), 10(*b*) and 10(*c*). As shown in FIG. 10(*a*), a cylindrical cam 66 is fastened to base frame 30. A lead pin 65 that engages a cam groove 67 of the cylindrical cam 66 is disposed at the punch member side. Configurations that are the same as those shown in FIG. 1 have the same symbols. Explanations of those members will be omitted.

The upper frame 30 and the lower frame 35 have the same structure as those shown in FIG. 1; both are integrally joined to form a unit. A drive motor M and drive shaft 60 that is connected to this drive motor M are disposed on the upper frame 30, as shown in FIG. 10(*a*). The same upper guide 31 and lower guide 32 as described above are equipped on the upper frame 30. The punch members 40 are slidably supported on the guide holes 31*a* and 32*a* of the upper and lower guides 31 and 32. The punch members 40 are disposed in plurality at appropriate positions. The drawings show the first to the fourth punch members 40*a*, 40*b*, 40*c*, and 40*d* disposed at predetermined spaces in four locations as described in relation to the first embodiment. Lead pins 65 are integrally formed on the shaft of each of the punch members 40*a* to 40*d*. The cylindrical cam 66 is fastened to the upper frame 30 and the cam groove 67 including the oblique cam surface 67θ is provided on the cylindrical cam 66; the lead pin 65 engages this cam groove 67. The oblique cam surface 67θ is inclined to a predetermined angle (θ) to the hole-punching direction (the up/down directions of FIG. 10(*a*)).

Figure 11:
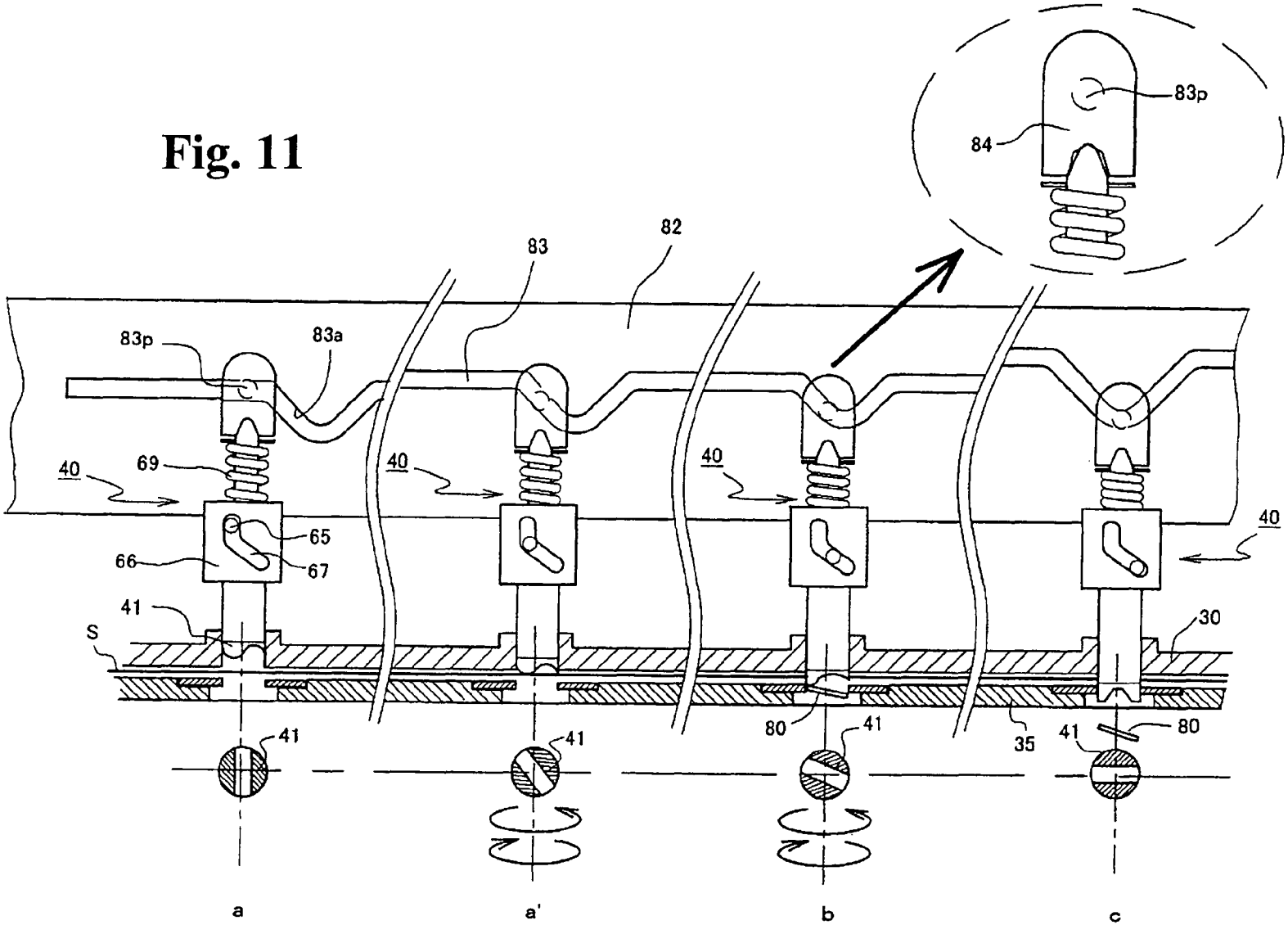
FIG. 11 is an explanatory diagram of the overall configuration of a third embodiment of the hole-punching device that is different from the device shown in FIG. 9.

The cylindrical cam 66 is formed of a synthetic resin, as described above; the punch members 40 are formed of a SUS type steel material; the hole-punching blade 41 is formed at the leading edge thereof. A shoulder-shaped flange 68 is provided at the shaft of the punch members 40. A return spring 69 is disposed between the shoulder-shaped flange 68 and the cylindrical cam 66. An eccentric cam 61 is installed on the drive shaft 60 as shown in FIG. 11(*a*). The first eccentric cam 61*a* is disposed at a position that opposes the first punch member 40*a*; the second eccentric cam 61*b* is disposed at a position that opposes the second punch member 40*b*; the third eccentric cam 61*c* is disposed at a position that opposes the third punch member 40*c*; and the fourth eccentric cam 61*d* is disposed at a position that opposes the third punch member 40*d*.

A first cam surface 61X is formed at a first position on the first and fourth eccentric cams 61*a* and 61*d*; the first cam surface 61X and second cam surface 61Y are each formed at two locations on the second and third eccentric cams 61*b* and 61*c*. Also, the first cam surfaces 61X of each eccentric cam 61*a* to 61*d* on the drive shaft 60 engage a top of the first to fourth punch members 40*a* to 40*d* substantially simultaneously. Specifically, the first punch member 40*a*, the second punch member 40*b*, the third punch member 40*c*, and the fourth punch member 40*d* engage in that order with a small time difference therebetween.

When the drive shaft 60 is rotated a predetermined angle at the first cam surface 61X position, the first to the fourth punch members 40*a* to 40*d* move in the hole-punching direction, to punch four holes in the sheet S.

When the drive shaft 60 is rotated a predetermined angle at the second cam surface 61Y position, the second and third punch members 40*b* to 40*c* move in the hole-punching direction, to punch two holes in the sheet S.

After punching the holes, the punch members 40*a* to 40*d* are returned to their original positions by the return spring 69. In the same way as was described in relation to the device shown in FIG. 1, an encoder and encoder sensor are disposed on the drive motor M, not shown. A position sensor is disposed at the home position of the drive shaft 60. Therefore, in the same way as the device of FIG. 1, through rotational control of the drive motor M either a two-hole punch or a four-hole punch is selected with the angle control of the cylindrical cam 66, and holes are punched at predetermined positions in the sheet S by each of the punch members 40*a* to 40*d*.

Figures 9A, 9B:
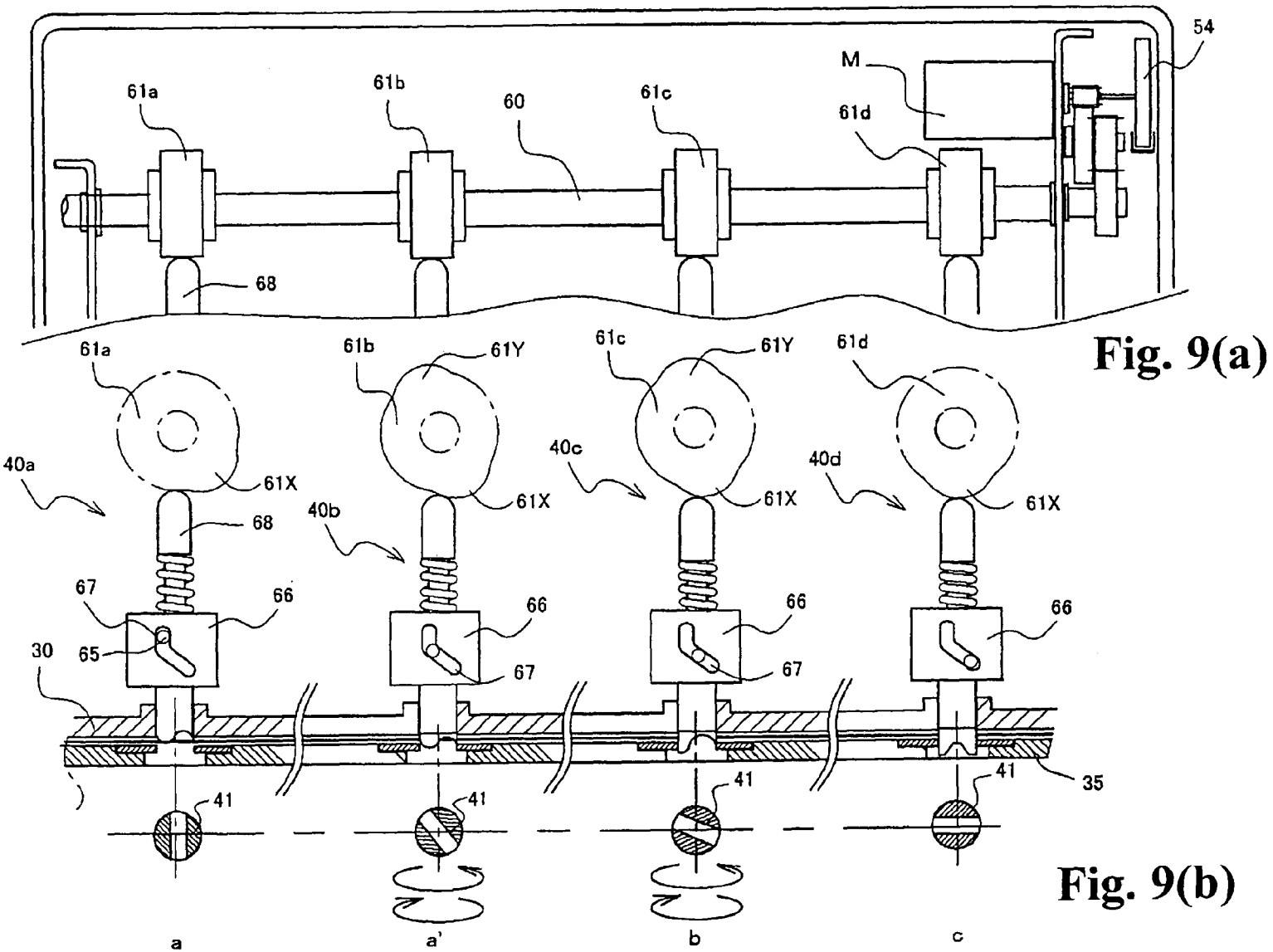
FIGS. 9(*a*) and 9(*b*) are explanatory diagrams of the overall configuration of a second embodiment of a hole-punching device that is different from the device shown in FIG. 1.
Figure 10A:
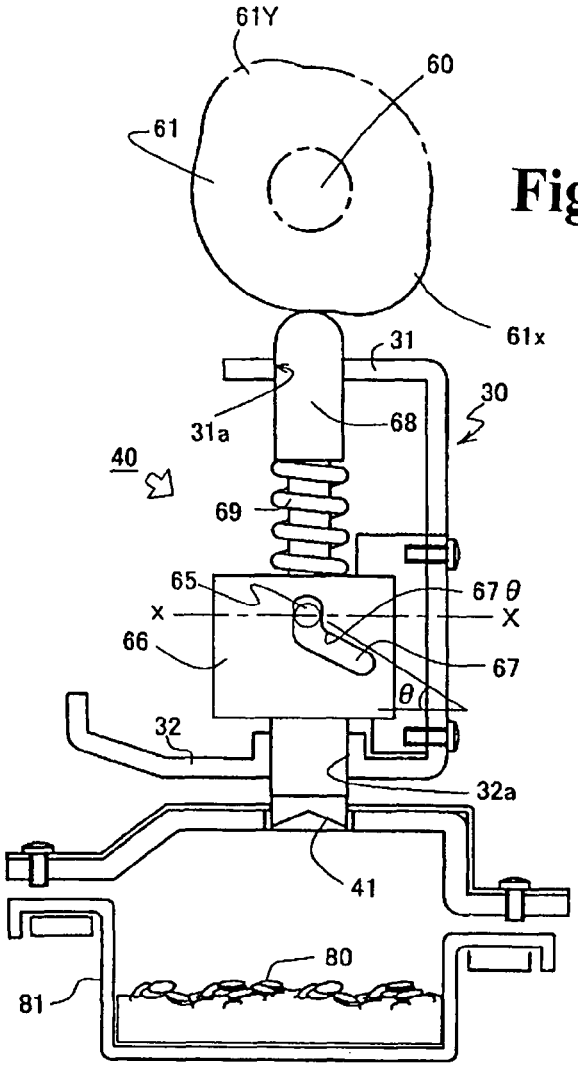
FIGS. 10(*a*) to 10(*c*) are explanatory diagrams of a drive rotation cam structure of the device shown in FIG. 9 (second embodiment) FIG. 10(*a*) is a front view of the drive cam; 10(*b*) is a sectional view of the essential portion; 10(*c*) is an explanatory view of the position detection of the home position.
Figure 10B:
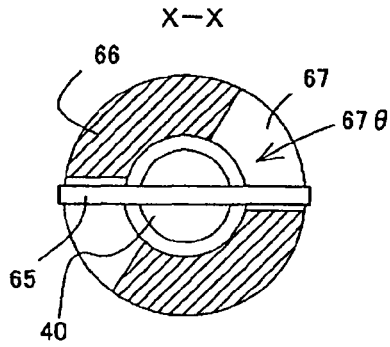
Figure 10C:
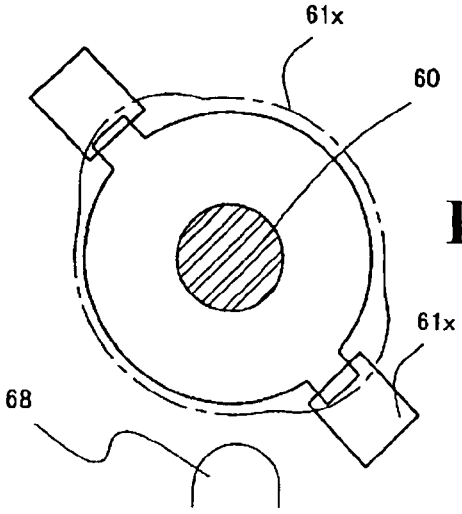

To explain the operations of the punch members 40*a* to 40*d* with reference to FIG. 9(*b*), the punch members 40 guided by the lead pin 65 along the oblique cam surface 67θ to rotate in the counterclockwise direction move from the top dead center a to the punching starting position a' and touch the sheet S. The hole-punching blade 41 penetrates the sheet S while the punch members 40 rotates in the same direction, and moves to the punching ending position b. Next, it moves to the bottom dead center c. Next, when the cylindrical cam 66 rotates further, the punch member 40 is moved from the bottom dead center c in the direction of the top dead center a by the return spring 69. At this time, the punch members 40 guided by the lead pin 65 along the oblique cam surface 67θ return to the punching ending point b while being rotated in the clockwise direction to return further to the hole punching starting position a', and recovering to the final top dead center a. In this way, the rotation of the punch members 40 that shuttle between the top dead center a and the bottom dead center c is reversed when it is advancing downward and retreating upward. For that reason, the paper cutting debris 80 adhering to the hole-punching blade 41 is separated from the leading edge of the blade by the centrifugal forces of the forward and revere rotations of the blade. The debris 80 is thus thrown in every direction, so it accumulates substantially evenly in the cuttings box 81 disposed below the lower frame 35 as shown in FIG. 4.

Third Embodiment of the Hole-Punching Device

The following will now explain a third embodiment shown in FIG. 11 that differs from the first and second embodiments. The configuration of the punch members 40 is the same as that described in relation to the second embodiment, so the same symbols will be used but an explanation thereof will be omitted. FIG. 11 shows each punch member 40 moving upward and downward with a predetermined stroke by the reciprocating movement of a sliding cam 82, instead of the drive cam (eccentric cam) 61. A V-shaped groove cam 83 is formed in the sliding cam 82 connected to the drive motor M, not shown. This V-shaped groove cam 83 is equipped with an oblique cam surface 83*a* inclined to a predetermined angle in the hole-punching direction. A cam follower pin 83*p* that engages the V-shaped groove cam 83 is implanted in a cap member 84 mated to the punch member 40. The cap member 84 is pivotably supported to rotate on the top end of the punch member 40. Other configurations are the same as the device shown in FIG. 9.

Reciprocating movement of the sliding cam 82 in the left and right direction of the drawing with a predetermined stroke causes the oblique cam surface 83*a* of the V-shaped groove cam 83 to push the following pin 83*p* from the top dead center a in the thrusting direction toward the bottom dead center c. The punch members 40 are thus moved from the top dead center a to the bottom dead center c while being rotated around their axis of rotation guided by the pin 83*p* along the oblique cam surface 67θ by receiving thrusting force. Next, when the oblique direction of the V-shaped groove cam 83 rotates in reverse, the punch members 40 are returned from the bottom dead center c to the top dead center a by the return springs 69. In the process, the punch members 40 punch holes in the sheet S while rotating in the counterclockwise direction when being moved from the top dead center a to the bottom dead center c, in the same way as FIG. 9. Then, the punch members 40 reverse their rotation to the clockwise direction and return from the bottom dead center c to the top dead center a. At that time, the paper cutting debris 80 adhering to the hole-punching blades 41 is thrown in all directions.

The description above explains punching two and four holes in the sheet S. However, by changing the spacing and the number of punch members 40 disposed, of course it is possible to attain three holes, or to punch four holes at the top and bottom of the sheet S by varying the center space. Also, a cam groove 45 is formed on the outer circumference of the cylindrical cam 44 in the device shown in FIG. 1, but it is also acceptable to form this only at the oblique cam surface 45θ and to reciprocate the punch members 40 using this cam portion. The shapes of the end surfaces of the hole-punching blades 41 of the present invention are described to be a U-shape or a V-shape, but it is also perfectly acceptable that this half-cut circular shape.

Position Control of the Home Position of the Punch Member

The configuration of the position control at the home position HP of the punch members 40 in the first, second and third embodiments will now be explained. The drive motor M is composed of a direct current motor, and is wire bound to a short circuit that includes resistors between motor terminals. This electric brake (dynamic brake) quickly stops the motor through heat consumption of the motor's rotational energy. A transmission member (the sliding member) 50 that performs the hole-punching operation with the punch members 40 is controlled by a drive control means DS that controls the rotation of the drive motor M. This drive control means DS, not shown, is composed of a control CPU of the finishing apparatus C, and executes the hole-punching operation with the punch members 40 by controlling the rotation of the drive motor M.

When the punch members 40 is stopped at a predetermined home position HP, the punching load will vary according to the sheet thickness and material. Therefore, brake means are necessary to stop the punch members 40 at a correct home position HP. This brake means can be composed of a mechanical brake means or an electric brake means. The brake means will now be explained.

Figure 13:
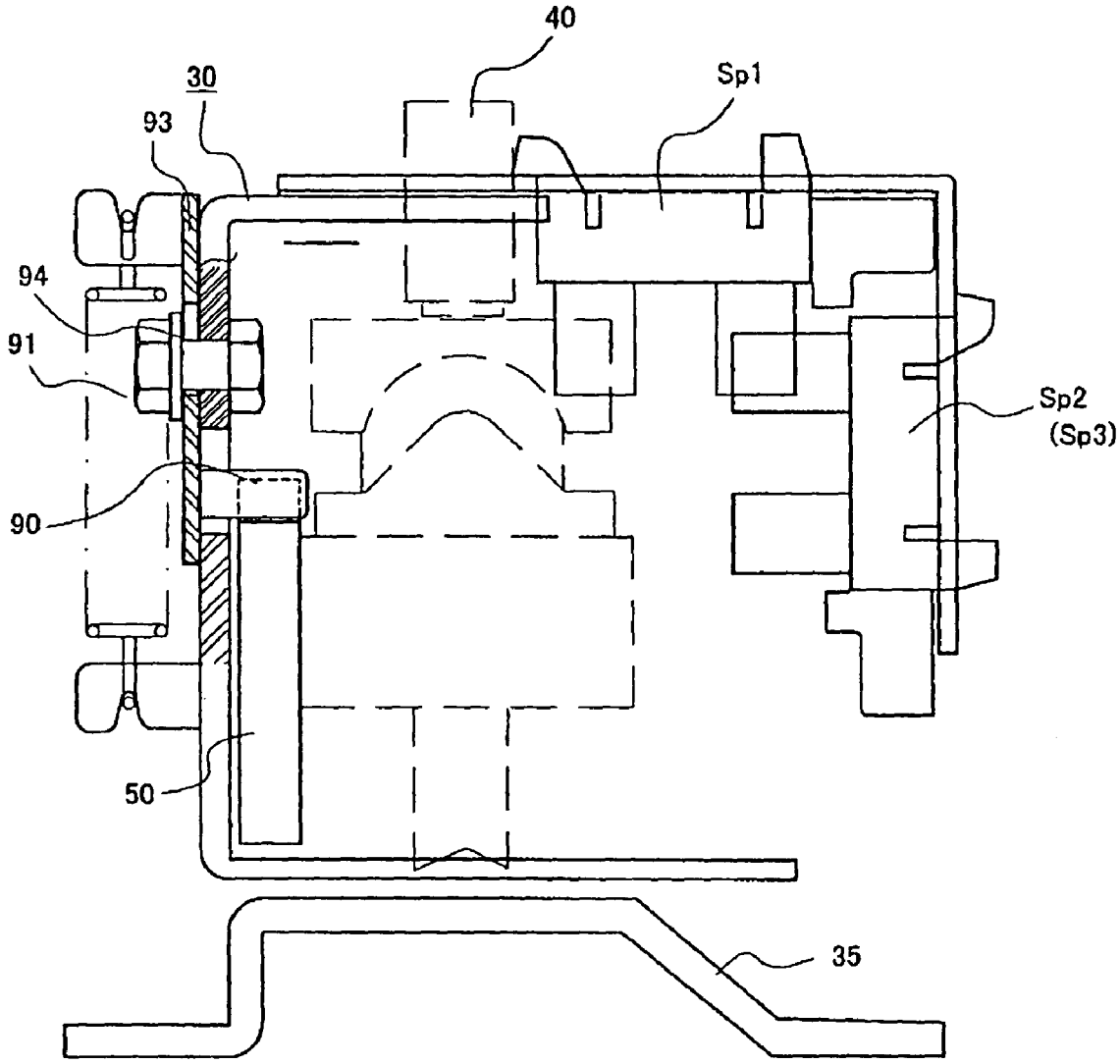
FIG. 13 is a sectional view showing a mechanical brake on the hole-punching devices shown in FIGS. 1, 9 and 11.
Figures 14A, 14B:
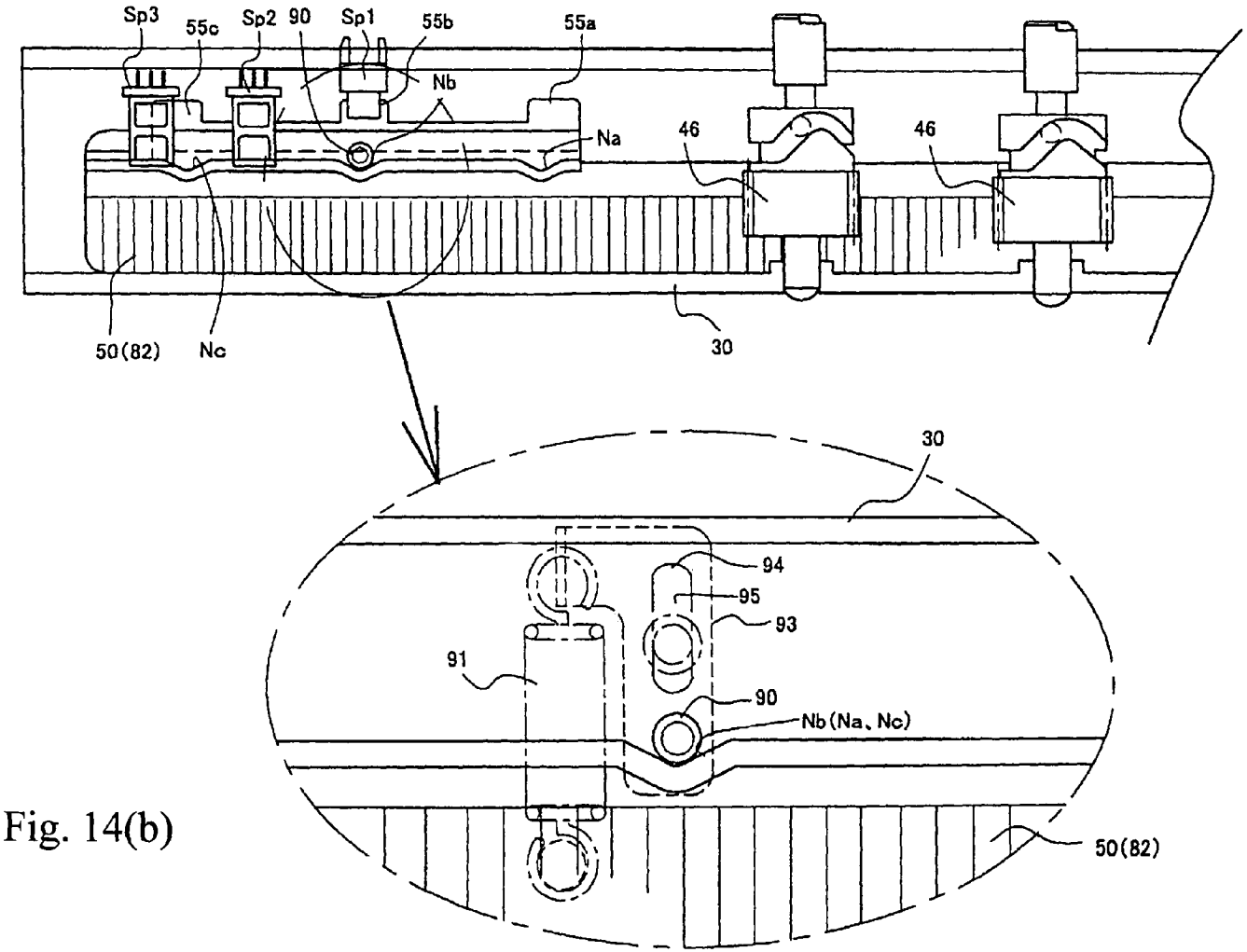
FIG. 14(*a*) is a plan view of the device shown in FIG. 13.

Configuration of the Mechanical Brake Means that Stops the Punch Members at a Home Position As shown in FIGS. 13 and 14, a brake shoe member 90 is equipped that increases the moving load on the sliding member 50 (82) at the home position HP. This stops the sliding member (either 50 or 82) at the first, second and third home positions HP1, HP2, and HP3. Concave grooves Na, Nb, and Nc are formed at these home positions HP1 to HP3. The brake shoe member 90 is disposed on the device frame 30 to be constantly engaged with the sliding member 50 (82) by the urging spring 91. This brake shoe member 90 is formed of a material having a high friction coefficient such as synthetic resins, or rubber materials, and is integrated to a bracket 93. This bracket 93 is installed by a pin 94 in a long hole 95 in the device frame 30. On this bracket 93, the urging spring 91 is installed to press the brake shoe member 90 against the sliding member 50 (82). The leading end of the brake shoe member 90 is formed to a shape to mate with the concave grooves Na, Nb, and Nc. Therefore, the sliding member 50 (82) is moved while it is in contact with the brake shoe member 90, but when the brake shoe member 90 engages one of the concave grooves Na to Nc positioned at home positions HP, a large load is applied. This load of the brake shoe member 90 prevents the sliding member 50 (82) from overrunning the home position.

Configuration of the Electric Brake Means

By adopting an electric brake means for the drive motor M the same position control of the sliding member 50 (82) is attained without having to rely on the mechanical brake means described above. The configuration of the electric brake means will now be explained.

The drive control means DS is composed of an electric brake disposed on the drive motor M that drives the punch members 40, and varies the operational timing of the electric brake (dynamic brake) to stop the punch members 40 at the home position HP. The electric brake means BR is configured to (a) vary the timing to stop the punch members 40 at the home position HP; (b) adjust the force of the rotational torque that starts the drive motor M; or (c) change the home position according to the thickness and/or material of the sheet to be punched with holes.

Figure 15:
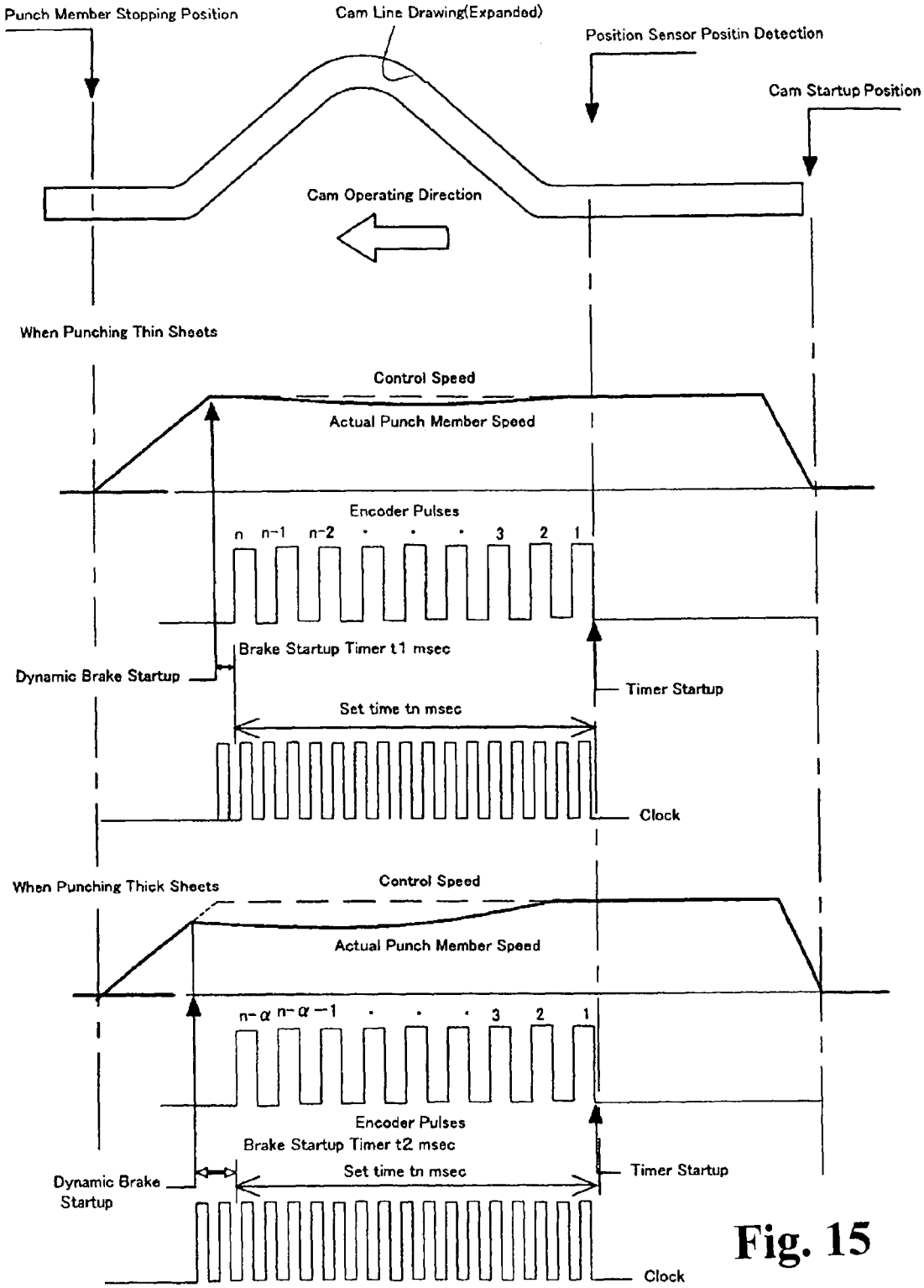
FIG. 15 is an explanatory view of the configuration of drive control of the first embodiment in the hole-punching devices shown in FIGS. 1, 9 and 11.

The following will now explain the varying of the operational timing of the brake means by detecting the hole-punching load. A hole-punching action detection means is provided that detects the "movement amount per predetermined amount of time" (first embodiment) or the "movement speed" (second embodiment) in the action (movement from the top dead center to the bottom dead center) of the punch members 40 to punch holes as described in relation to the first, second and third embodiments described above. Also, the drive control means DS varies the operational timing of the electric brake means BR according to the detection results from the hole-punching action detection means. As shown in FIG. 15 for the first embodiment, the hole-punching action detection means is configured to detect the movement of the punch members 40 per a preset time (tn msec). Shown in the drawing, a timer is set when the second sensor flag 56 for position detection, equipped on the sliding member 50 described above is detected by the second and the third position sensors Sp2 and Sp3. When a preset time of tn seconds has passed on the timer, the drive motor M encoder pulses are counted.

The counted number of pulses is compared to a reference value to set the operation timing of the dynamic brake (electric brake means) BR equipped on the drive motor M. For example, if the reference value is set to a standard sheet thickness, and the counter of the encoder 54 is lower than this reference value, the sheet is determined to be a thick sheet; if the counter is higher than that reference value, the sheet is determined to be a thin sheet. When the sheet is determined to be a thin sheet, the drive control means DS starts the dynamic brake BR t1 second after that detection. When the sheet is determined to be a thick sheet, the drive control means DS starts the dynamic brake BR t2 seconds after that detection (t2>t1). By adopting this configuration, it is possible to always stop the punch members 40 at the fixed stopping position regardless of whether the sheet is thick or thin.

The timing for starting the dynamic brake BR is set with a correlative relationship between the hole-punching speed (amount of movement within a predetermined time) and braking time. This is determined by advance testing. In other words, tests are conducted to determine which timing corresponds to the distance traveled within a predetermined time to stop the punch members 40 at the fixed stopping position. Therefore, the hole-punching action detection means, not shown, is composed of a clock means, such as a control clock and position detection means (such as an encoder, position sensor, and the like) that detects the number of drive motor M rotations (it is also acceptable for the amount of movement of the punch member or sliding member). The drive control means DS is composed of comparing means such as a table memory set by advance testing of the brake startup timing (t1 and t2), and a comparator.

Figure 16:
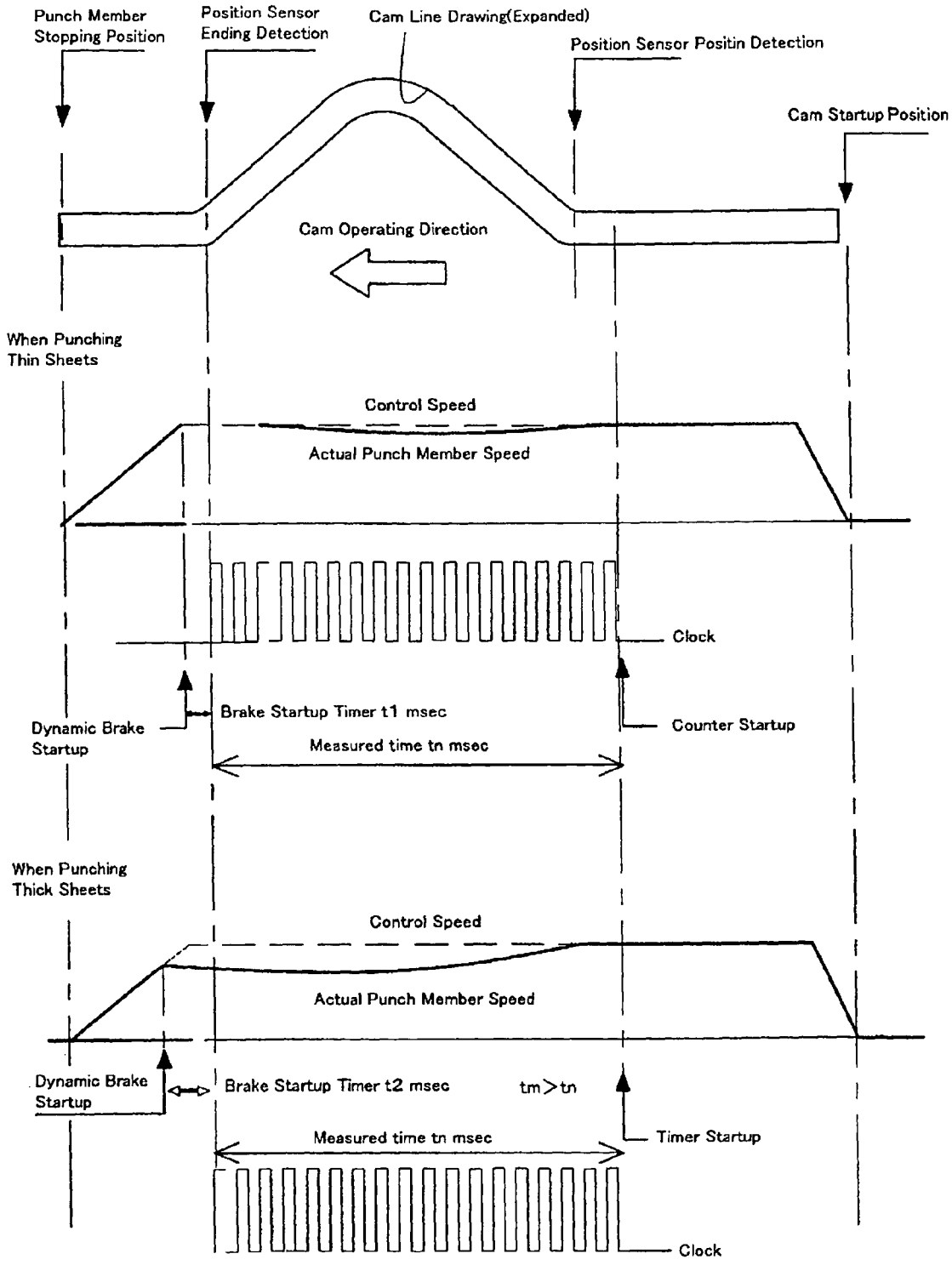
FIG. 16 is an explanatory view of the configuration of drive control of the second embodiment in the hole-punching devices shown in FIGS. 1, 9 and 11.

Next, in the second embodiment shown in FIG. 16, the hole-punching action detection means is configured to detect the moving time of a predetermined range (a measured stroke) in the hole-punching action of the punch members 40 described above. The moving time of the punch members 40 that move from the top dead center to the bottom dead center is detected using a reference clock such as a CPU, for example.

If the detected time is long, the sheet is determined to be a thick sheet; if the detected time is short, the sheet is determined to be a thin sheet. The startup timing of the dynamic brake BR is then adjusted accordingly to stop the punch members 40 at the predetermined position. Shown in the drawing, the second sensor flag 56 of the sliding member 50 is detected by the second and third position sensors Sp2 and Sp3 to set the starting position (starting point of the measured stroke) of the hole-punching action. Time is measured by clock means from this startup position. When the punch members 40 finishes the hole-punching action, the second sensor flag 56 is detected by the second and third position sensors Sp2 and Sp3. The times (tn, and tm in the drawing) that these position sensors detect the ending position are compared to a predetermined reference value (time). If the times are longer than the reference time, the sheet is determined to be thick; if the times are shorter than the reference times, the sheet is determined to be thin, and the timing of the operation of the dynamic brake BR equipped on the drive motor M is set.

For example, if the reference value is set to a standard sheet thickness, and the clock time of the clock means is longer than this reference value, the sheet is determined to be a thick sheet. Conversely, if the clock time of the clock means is shorter than this reference value, the sheet is determined to be a thin sheet. When the sheet is determined to be a thin sheet, the drive control means DS starts the dynamic brake BR t1 second after that detection. When the sheet is determined to be a thick sheet, the drive control means DS starts the dynamic brake BR t2 seconds after detection (t2>t1). Note that the operational timing of the dynamic brake BR is preset by the same testing that was described above. By adopting this configuration, it is possible to always stop the punch members 40 at the fixed stopping position regardless of whether the sheet is thick or thin.

The following will explain the varying of the action timing of the brake means according to sheet thickness.

Figure 17:
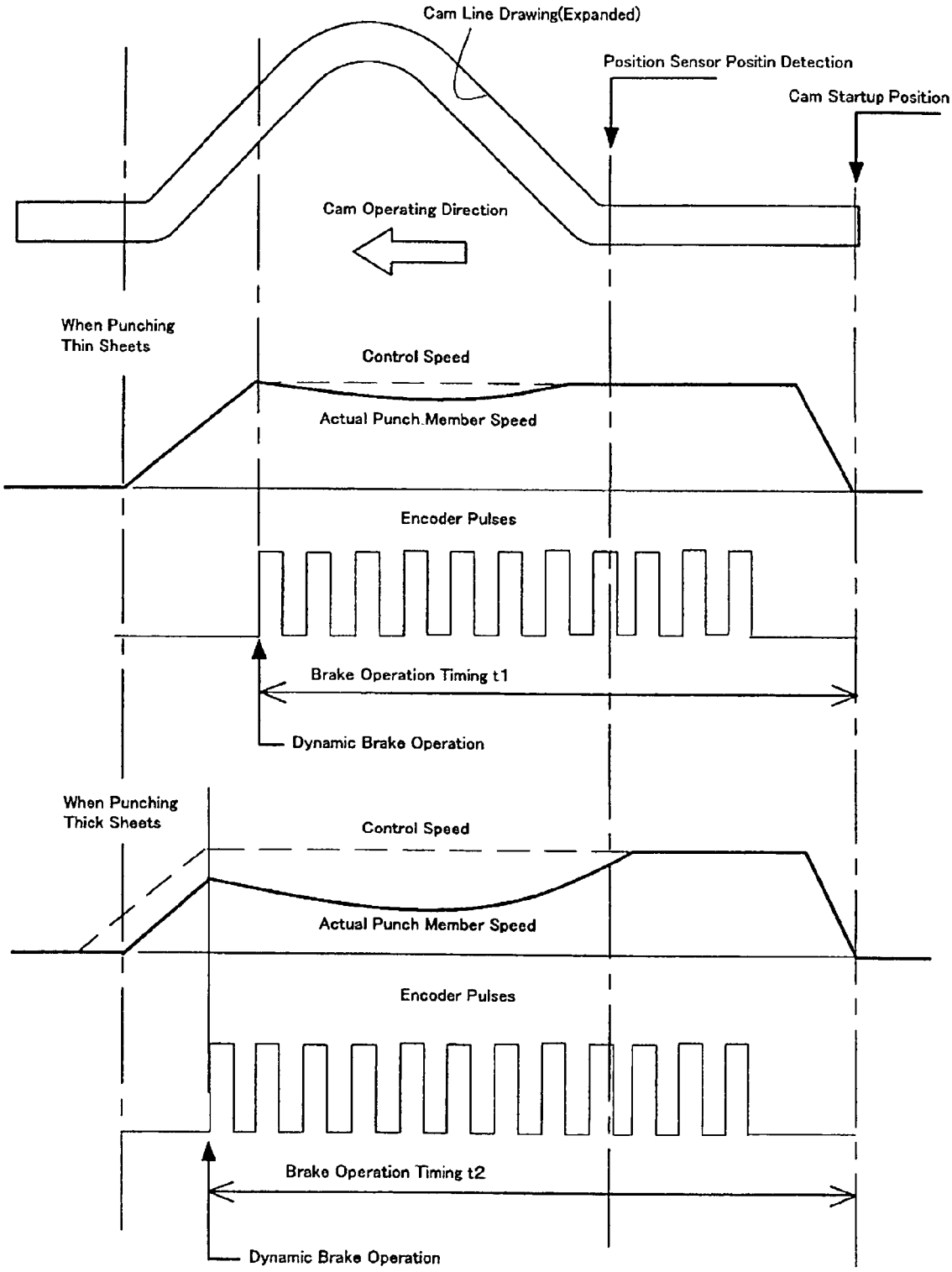
FIG. 17 is an explanatory view of the configuration of drive control of the third embodiment in the hole-punching devices shown in FIGS. 1, 9 and 11.

Next, as shown in FIG. 17, the third embodiment varies the startup timing of the dynamic brake BR according to the thickness and or material of the sheet to be punched with holes. The dynamic brake shown in the drawings is controlled as shown in FIG. 17. The drawing shows the control when cam means 44 moves from the home position HP2 to HP1. A predetermined electric power is supplied to the drive motor M at the home position HP2. Also, for example the timing for the cam means to end the hole-punching operation is detected by the first sensor flag 55*b*, and the pulses of the encoder 54 linked to the drive motor M are detected after the end of the hole-punching operation. This pulse activates the dynamic brake BR after a preset amount of time is passed When that happens, the punch members 40 stop with a control torque corresponding to the motor rating (armature), thereby varying the stopping position according to the thickness and/or material of the sheet S to be punched with holes.

The drive control means DS (for example the control CPU) that controls the drive motor M selects the operation starting timing of the break means according to the thickness and/or material of the sheet S to be punched with holes. Pulses of the encoder 54 connected to the drive motor M are counted from the position where the sliding member 50 is detected to have passed the first sensor flag 55*b*. When the pulses have reached a preset number, the terminals of the drive motor M are shorted, and the rotating energy is converted to thermal energy of the resistor. The braking torque generated in this way quickly stops the drive motor M. Note that thicknesses of the sheet S to be punched with holes are classified into two groups. When the sheet S to be punched with holes is thin, the action time of the brake is set to t1. If the sheet S is thick, the action time of the brake is set to t2. The device shown in the drawings is configured so that t2>t1. Therefore, when the sheet S is thick, the operation startup timing of the dynamic brake BR is configured to be slower than when the sheet S is thin. Note that the timing for starting operation of the brake means is not limited to two die plates, and can be set to three or more die plates. It is also acceptable to configure the timing to be set according to each of the thicknesses of sheet S to be punched with holes.

The brake action timing is set to stop the punch members 40 at substantially the same position according to the braking torque generated from the characteristics of the drive motor M, regardless of the thickness of the sheet. It is preferred that this timing (for example the encoder pulse) is determined by testing. Therefore, the brake action starting time set according to the sheet thickness is stored as a data table in the control circuit RAM, and is selected based on a separate detection or based on information input about sheet S thickness.

The following will explain the varying of the drive motor torque according to sheet thickness.

Figure 18:
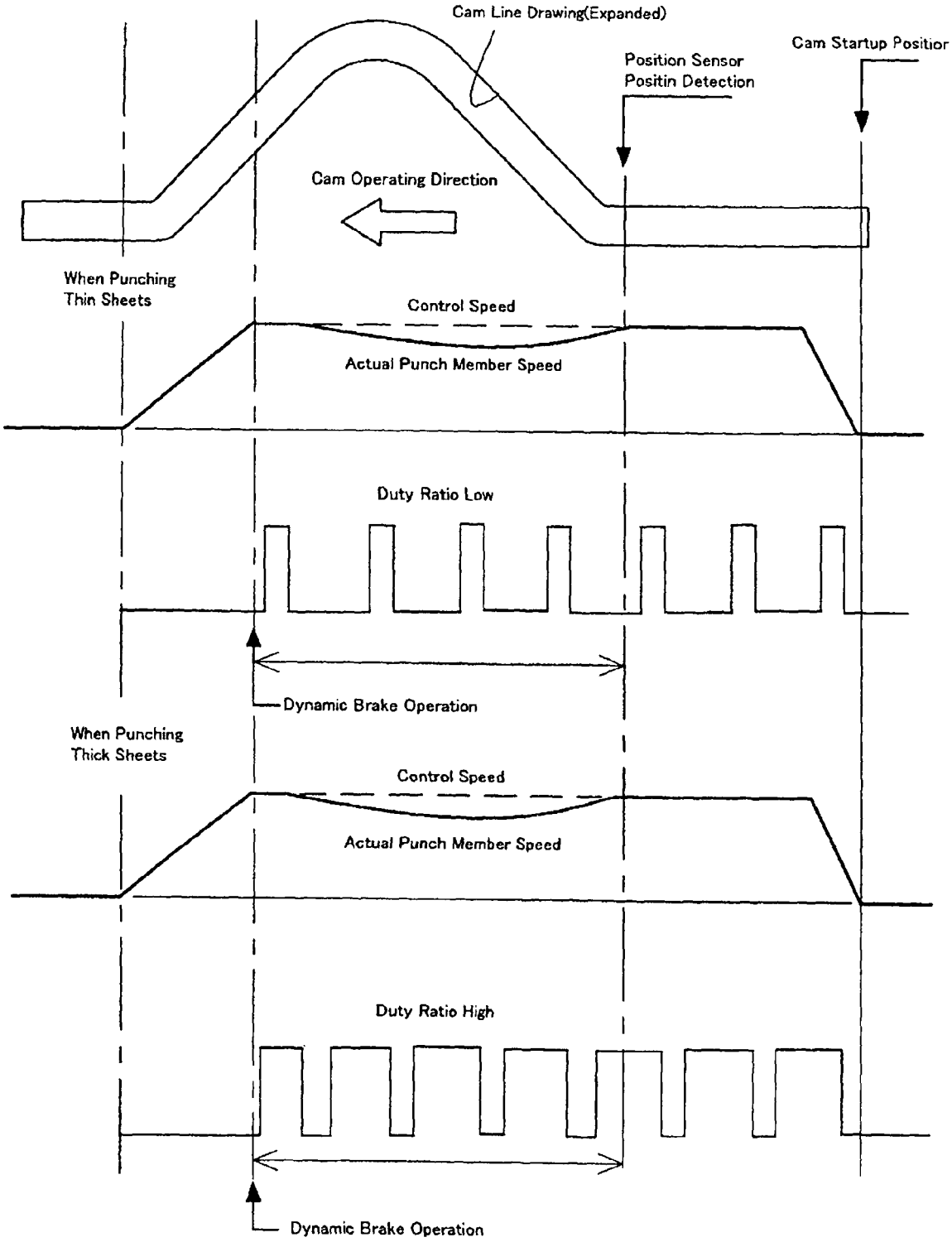
FIG. 18 is an explanatory view of the configuration of drive control of the fourth embodiment in the hole-punching devices shown in FIGS. 1, 9 and 11.

The embodiment 4 of FIG. 18 shows adjusting the electric pulse duty supplied to the drive motor M according to paper thickness (or material). The pulse power shown in FIG. 18 is supplied to the drive motor M. The pulse power is composed to enable high and low adjustments of the duty ratio of the PWM control (pulse width modulation control). Also, the duty ratio size is changed according to the sheet thickness and/or material by the control signal from the drive control means DS. Also, this duty ratio is set to stop the punch members 40 at the predetermined home position HP. For example, when the sheet is thick, the duty ratio is set to be large (high); when the sheet is thin, the duty ratio is set to be small (low). This makes it possible to always stop the punch members 40 at the predetermined home position HP regardless of the thickness or material of the sheet S to be punched with holes.

Specifically, the duty ratio (motor on time/(motor on time+motor off time)) of the power pulse charged to the drive motor M is set to several die plates of the "duty ratio for thick sheets" and "duty ratio for thin sheets." The appropriate duty ratio is selected from a separate detection, or based on input sheet S thickness information to supply electric power to the drive motor M at that duty ratio. When punching holes in a thick sheet S that has a large hole-punching load, the power supplied to the drive motor M is high. When the sheet S is thin, the power is lower. Therefore, the output of the drive motor M is adjusted to be high or low according to the thickness of the sheet S to be punched with holes, and the speed of execution of the punch members 40 is substantially the same.

Note that in this case, the electric brake means (dynamic brake) BR is used, in the same way as described above, to stop at the drive motor M home position. The brake means is configured to activate the dynamic brake BR just prior to the stopping position by detecting the ending timing of the hole-punching operation, in the same way as described above, using the first position sensor Sp1, and counting a predetermined number of encoder pulses from that detection signal. This makes it possible to stop the punch members 40 at the predetermined home position HP regardless of the thickness of the sheet S to be punched with holes.

The following will explain the varying of the home position of the punch members according to sheet thickness.

Figure 19:
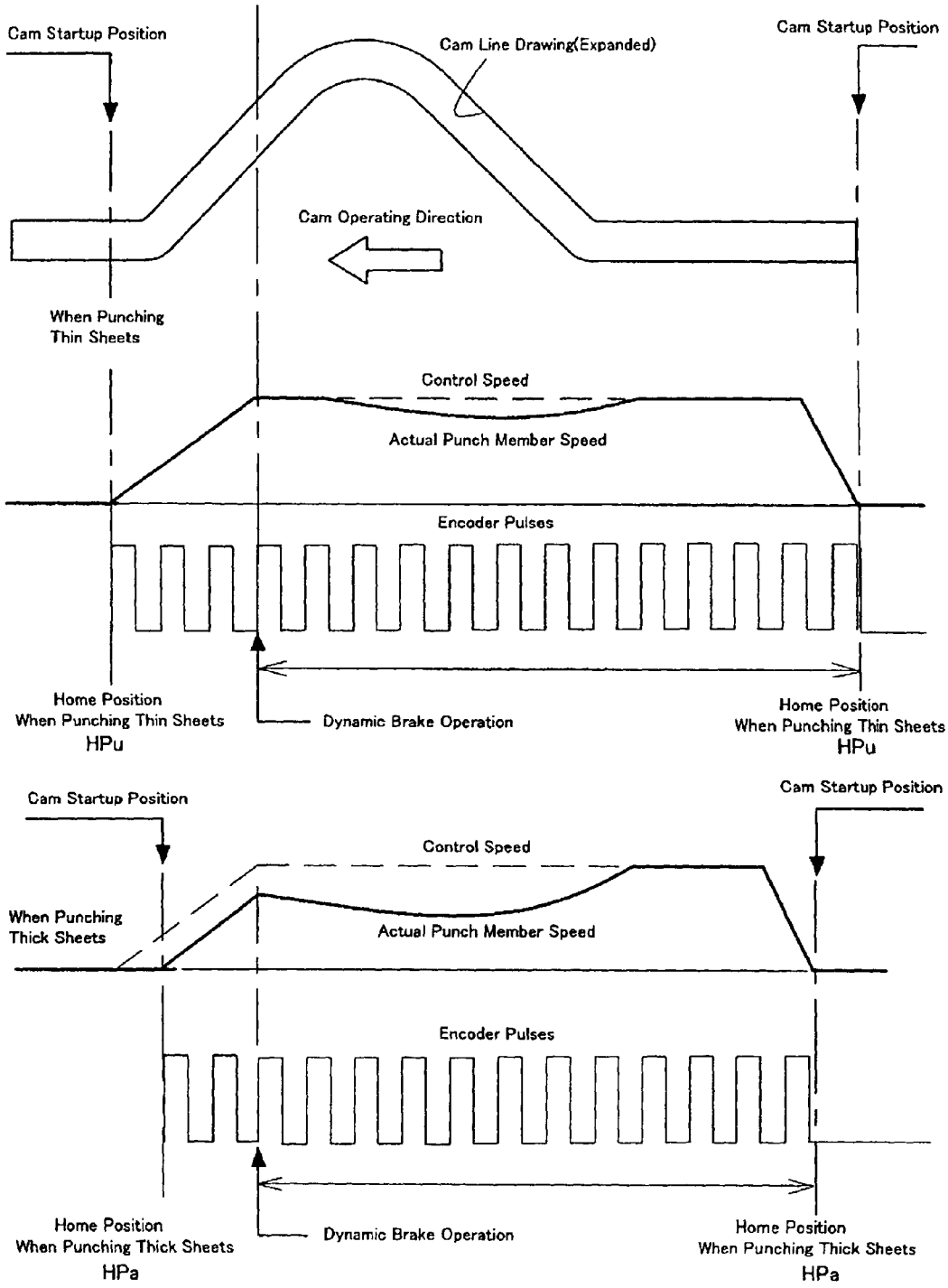
FIG. 19 is an explanatory view of the configuration of drive control of the fifth embodiment in the hole-punching devices shown in FIGS. 1, 9 and 11.

Next, a fifth embodiment of the present invention will now be explained with reference to FIG. 19. A direct current motor composes the drive motor M of the first, second and third embodiments. When this motor drivingly controls the punch members 40, the home position can be selected from a plurality of positions according to the thickness of the sheet S to be punched with holes. For example, to describe the configuration of the first embodiment explained with reference to FIG. 1, HP1, HP2, and HP3 are each set as home positions (home position HPa for thick sheets; and HPu for thin sheets). The drive control means DS is configured to set the home position based on information from input means that inputs paper thickness information or thickness detection means, both described below, that detects sheet thickness.

In this case, the drive motor M is started from the home position HP1, and at the same time, the encoder pulses are counted from the startup position, for example. After an estimated amount of time for the punching operation of the punch members 40 to end, the dynamic brake BR, described above, is activated when the encoder pulses of the drive motor M reach a predetermined number. When this happens, the punch members 40 are stopped at the home position HPu shown in the drawing when the sheet S is thin, and at home position HPa when the sheet S is thick. Therefore, it is possible to move the punch members 40 between the home positions HP2 and HP1, and HP3 with a stroke corresponding to the thickness of the sheet S, and the control is simple.

The following will explain the configuration of the input means and thickness detection means that transfer information of the sheet S to be punched with holes to the drive control means DS. The thickness and material of the sheet S are detected or input in the following ways. The first method disposes a sensor that detects sheet thicknesses, at a sheet conveyance path of the finishing apparatus C described above. This sensor detects sheet thicknesses. An ultrasonic wave sensor is disposed in the sheet conveyance path to irradiate ultrasonic waves from an oscillating element onto sheets passing through the path, and receiving the ultrasonic waves that pass through the sheets with a receiving element, to detect sheet thicknesses. The amount of attenuation of the ultrasonic waves from the oscillating element received at the receiving element is used to detect sheet thickness. Another method is to irradiate light onto sheets passing through the path, and detecting the light that passes through the sheet with a light receiving element to detect the thickness of the sheet from the amount of light attenuation. These detection elements are widely known and used in the art.

The second method equips a control panel on the finisher apparatus C or the image forming apparatus B. An operator inputs the thickness of the sheets using the control panel. It is also possible to classify the sheet supply paths for sheets with the image forming apparatus or the finisher apparatus into one for thin sheets (thin sheet cassette), and one for thick sheets (thick sheet cassette), and then to identify whether a sheet is thick or thin by information from the apparatus supplying the sheet.

Finisher Apparatus

Figure 20A:
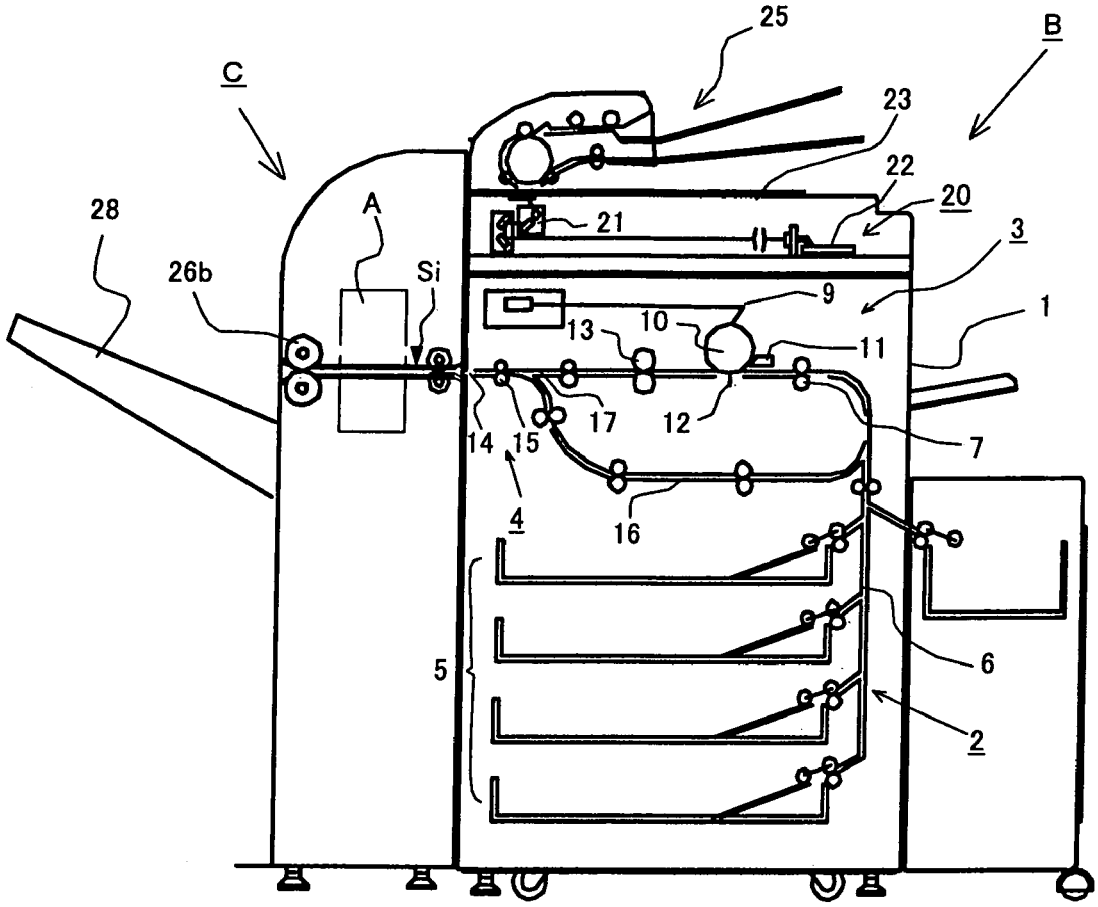
FIGS. 20(*a*) and 20(*b*) are explanatory drawings of a finisher device in an image forming apparatus according to the present invention.
Figure 20B:
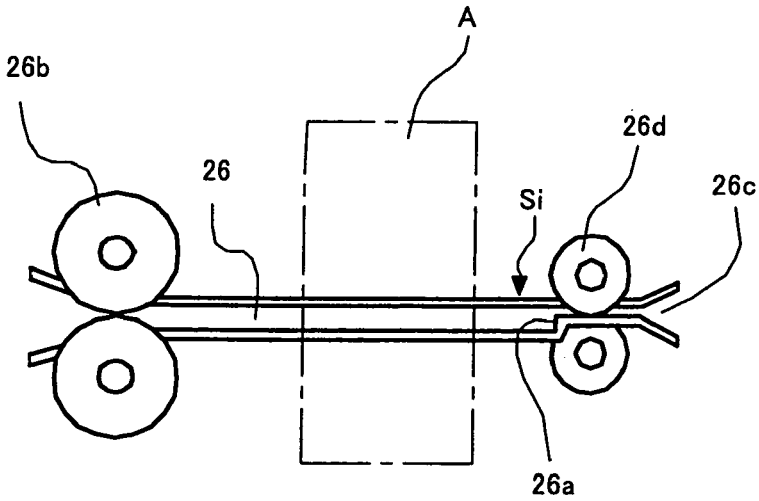

The image forming apparatus B and finisher apparatus C according to the present invention will now be explained with reference to FIG. 20. The image forming system shown in FIG. 20 is composed of the image forming apparatus B that sequentially prints sheets, and the finisher apparatus C installed downstream of the image forming apparatus B. Sheets printed at the image forming apparatus B are punched with holes at the finisher apparatus C. First, the image forming apparatus B can adopt any of the structures of a copier, printer or printing machine. The drawing shows an electrostatic printing system. This image forming apparatus B has a feeding unit 2, printing unit 3, discharge unit 3 and control unit (not shown) in the casing 1. A plurality of cassettes 5 corresponding to sheet sizes is prepared at the feeding unit. Sheets of the size specified by the control unit are fed to the sheet feed path 6. A registration roller 7 is equipped at the sheet feed path 6. After the leading edge of the sheet is registered by this roller, it is fed at a predetermined timing to the downstream printing unit.

A static electric drum 10 is equipped at the printing unit 3. A print head 9, developer 11 and transfer charger 12 are disposed around this drum 10. The print head 9 is composed of a laser emitter, for example, to form electrostatic latent images on the electrostatic drum 10. Toner ink adheres to the latent image at the developer 11, and is this is transferred and printed on the sheet at the transfer charger 12. The printed sheet is the fixed at the fixer 13 and discharged to the discharge path 17. A discharge outlet 14 formed in the casing 1 and a discharge roller 15 are disposed at the discharge unit 4. Note that the symbol 16 in the drawing represents a recirculation path. A printed sheet from the discharge path 17 is turned over from front to back at the switchback path and fed to the registration roller 7 to be formed with images on its backside. In this way, a sheet formed with images on one side or both sides is conveyed from the discharge outlet 14 by the discharge roller 15.

Note that the symbol 20 in the drawing is a scanner unit. This optically reads original images to print using the print head 9. As is generally known in the art, the scanner is composed of a platen 23 where an original sheet is set; a carriage 21 that scans the original image along the platen 23; and an optical reading means (for example, a CCD device) that photo-electrically converts optical images received from the carriage 21. The drawing shows an original feeding apparatus 25 that automatically feeds the original sheet to the platen, installed over the platen 23.

The finisher apparatus C is connected to the discharge outlet 14 of the image forming apparatus B. The finisher apparatus C is composed of a sheet conveyance path 26, a punch unit 27 and discharge stacker 28 disposed on this conveyance path 26. Registration means 26*a* is equipped at an upstream side of the punch unit 27 in the sheet conveyance path 26, to register a trailing edge of the sheet. Forward and reverse rotating rollers 26*b* are disposed in the sheet conveyance path 26. Sheets from the conveyance inlet 26*c* abut the registration means 26*a* for registration, and at the same time, the forward and reverse rotating rollers 26*b* convey out the sheet from the punching unit 27 to the discharge stacker 28. The symbol Si in the drawings represents a sheet detection sensor. Note that the punch unit 27 is composed of either the device shown in FIG. 1, 9 or 11.

The finisher apparatus C with this configuration receives the sheet printed at the image forming apparatus B, detects the trailing edge of the sheet using the sheet detection sensor Si, and reverses the rotation of the forward and reverse rotating rollers 26*b* (counterclockwise direction of the drawing) at a timing after the trailing edge of the sheet exits the registration means 26*a*. When this happens, the sheet is switched back and the trailing edge of the sheet is registered at the registration means 26*a*. After registration, the forward and reverse rotating rollers 26*b* stop and hold the sheet at that position. In this state, the punching unit 27 executes the hole punching operation described above by the drive of the drive motor M. After the punching operation has been executed, the forward and reverse rotating rollers 26*b* rotate in the clockwise direction of the drawing at the end signal from the first position sensor Sp1 to convey out the punched sheet to the discharge stacker 28. Note that although they are not shown in the drawing, the finisher apparatus C can include a staple unit and/or marking unit to apply marks as required by the apparatus specifications.

Explanation of the Hole-Punching Method

As is clear from the explanation of the various embodiments above, punch members 40 that are moved between a top dead center a and a bottom dead center c are provided. The hole punching method of punching holes with the punch members 40 at one or a plurality of locations of a sheet S set on a die plate will now be explained. First, one (or a plurality of) sheet S is set on the die plate 35 at a predetermined position. For example a sheet conveyance roller such as the finisher apparatus C can feed and set the sheet S to the correct posture on the die plate. Next, the punch members 40 are moved from the top dead center a toward the bottom dead center c (the hole-punching step) by the drive motor M and the transmission means connected thereto. This punches holes in the sheet S at one or a plurality of locations. Next, the punch members 40 are moved from the bottom dead center c to the top dead center a (the recovery step). Following this recovery step, the sheet S punched with holes is conveyed out from the die plate 35 (the sheet conveyance out step) to complete the hole-punching process. Note that the sheet conveyance out step conveys the sheet S from the die plate 35 when at least the punch members 40 that have recovered from the bottom dead center c to the top dead center a have moved from the bottom dead center c to the hole-punching point b.

With the hole-punching step described above, the punch members 40 are rotated around the axis of rotation when being moved from the top dead center a to the bottom dead center c. Also, when the punch members 40 are (1) moved from the bottom dead center c to the top dead center a, or (2) moved from the top dead center a to the bottom dead center c with the hole-punching step of a subsequent sheet, the punch members 40 are rotated in reverse around the axis of rotation.

Note that the operation of (1) is as described in the explanation of the second and third embodiments; the operation of (2) is as described in the explanation of the first embodiment. Specifically, in the case of (1), the punch members 40 in the hole-punching step are moved from the bottom dead center c while being rotated around the axis of rotation, and in the recovery step, they are moved to the top dead center a while being rotated in the reverse direction around the axis of rotation. Also, in the case of (2), the punch members 40 in the hole-punching step move from the top dead center a to the bottom dead center c while being rotated around the axis of rotation; this rotation reverses direction for the leading sheet sequentially fed and set on the die plate 35, and for the next sheet.

In explanation of the configurations of the devices shown in FIGS. 1 and 11, the punch members 40 are rotatingly driven by the sliding member 50 connected to the drive motor M, and the gear rack 51 formed on the sliding member 50. It is also acceptable to use a timing belt and transmission mechanism such as a gear train with the punch members 40 and drive motor M, without equipping the sliding member 50.

What is claimed is:

1. A sheet hole-punching device, comprising:

a plurality of punch members, each punch member having a leading end with a hole-punching blade;

a base frame for movably supporting the punch members in a hole-punching direction;

a drive motor for driving the punch members;

transmission means for transmitting rotational force of the drive motor to the punch members so as to rotate the punch members and to reciprocally move the punch members in the hole-punching direction, the transmission means being disposed between the drive motor and the punch members and comprising a gear rack linearly moving between first and second home positions by the drive motor, and passive gears formed on the punch members for mating with the gear rack to rotate the punch members; and a plurality of cam means, a cam means of the plurality of cam means being disposed between the base frame and each punch member of the plurality of punch members, for converting a rotational movement of the punch members into a hole-punching direction movement so as to move the punch members in the hole-punching direction while rotating the punch members.

2. The sheet hole-punching device according to claim 1, wherein each cam means of the plurality of cam means comprises a cylindrical cam having an oblique cam surface inclined to a predetermined angle with regard to the hole-punching direction of the punch member, and a follower pin for engaging the oblique cam surface, said cylindrical cam being disposed at one of the punch member and the base frame, and the follower pin member being disposed at the other of the punch member and the base frame.

3. The sheet hole-punching device according to claim 2, wherein the oblique cam surface is disposed on the punch member, and the follower pin member is disposed on the base frame so that the punch member is moved in the hole-punching direction while being rotated.

4. The sheet hole-punching device according to claim 3, wherein when the gear rack moves from the first home position to the second home position, the passive gear rotates in one direction, and when the gear rack moves from the second home position to the first home position, the passive gear rotates in a direction opposite said one direction, and the punch member punches a hole in a sheet when the gear rack moves from the first home position to the second home position, and further punches a hole in a subsequent sheet when the gear rack moves from the second home position to the first home position.

* * * * *